US011443696B2

(12) United States Patent
Lin et al.

(10) Patent No.: US 11,443,696 B2
(45) Date of Patent: Sep. 13, 2022

(54) APPARATUS AND METHOD FOR DRIVING DISPLAY PANEL IN POWER SAVING MODE

(71) Applicant: KUNSHAN YUNYINGGU ELECTRONICS TECHNOLOGY CO., LTD., Kunshan (CN)

(72) Inventors: Kun-Yueh Lin, Hsin-Chu (TW); Hong-Zhang Lin, Taichung (TW); Chun-Ta Wu, Taipei (TW); Yu-Hsun Peng, Hsin-Chu (TW)

(73) Assignee: KUNSHAN YUNYINGGU ELECTRONIC TECHNOLOGY CO., LTD., Kunshan (CN)

( * ) Notice: Subject to any disclaimer, the term of this patent is extended or adjusted under 35 U.S.C. 154(b) by 54 days.

(21) Appl. No.: 16/983,795

(22) Filed: Aug. 3, 2020

(65) Prior Publication Data

US 2022/0036827 A1 Feb. 3, 2022

(51) Int. Cl.
*G09G 3/3266* (2016.01)
*G09G 3/3275* (2016.01)

(52) U.S. Cl.
CPC ..... *G09G 3/3266* (2013.01); *G09G 3/3275* (2013.01); *G09G 2310/0278* (2013.01); *G09G 2330/021* (2013.01)

(58) Field of Classification Search
CPC ..... G09G 3/32; G09G 3/3233; G09G 3/3266; G09G 3/342; G09G 3/36; G09G 2310/0237; G09G 2310/024; G09G 2310/08; G09G 2320/0257; G09G 2320/064
See application file for complete search history.

(56) References Cited

U.S. PATENT DOCUMENTS

| | | | | |
|---|---|---|---|---|
| 10,636,356 | B1 * | 4/2020 | Qian | G09G 3/3266 |
| 2015/0049070 | A1 * | 2/2015 | Ren | G09G 3/3233 345/211 |
| 2019/0139496 | A1 * | 5/2019 | Peng | G09G 3/32 |

FOREIGN PATENT DOCUMENTS

| | | | |
|---|---|---|---|
| CN | 104464675 | A | 3/2015 |
| CN | 108133688 | A | 6/2018 |
| CN | 108337363 | A | 7/2018 |
| CN | 108885855 | A | 11/2018 |
| CN | 109348016 | A | 2/2019 |
| CN | 110023881 | A | 7/2019 |
| CN | 110400539 | A | 11/2019 |
| CN | 110402461 | A | 11/2019 |
| KR | 20200030415 | A | 3/2020 |

OTHER PUBLICATIONS

International Search Report and Written Opinion from corresponding PCT Application No. PCT/CN2021/110393 dated Oct. 26, 2021 (9 pages).

* cited by examiner

*Primary Examiner* — Nelson M Rosario
(74) *Attorney, Agent, or Firm* — Bayes PLLC

(57) ABSTRACT

An apparatus for display an active region having a plurality of light-emitting elements, a gate scanning driver operatively coupled to the active region and configured to stop a gate scanning signal to the plurality of light-emitting elements in a period, and a light emitting driver operatively coupled to the active region and configured to cause the plurality of light-emitting elements to emit light in the period.

18 Claims, 13 Drawing Sheets

602

500

600

601

602

APPARATUS AND METHOD FOR DRIVING DISPLAY PANEL IN POWER SAVING MODE

BACKGROUND

The disclosure relates generally to display technologies, and more particularly, to display panel driving.

Flat panel displays have been used as displays or monitors of information appliances, such as computers and portable devices. Among the various types of flat panel displays, displays made from organic light-emitting diodes (OLEDs) employs the OLEDs, often arranged in an array, to emit light, displaying an image. Portable devices having OLED flat panel displays often have good luminous efficiency, high brightness, fast response, and are lightweight. These portable devices also have advantages such as portability and mobility. In this regard, it is necessary to minimize the power consumption of portable devices to allow users to enjoy the convenience brought by these features.

SUMMARY

In one example, an apparatus for display includes an active region having a plurality of light-emitting elements, a gate scanning driver operatively coupled to the active region and configured to stop a gate scanning signal to the plurality of light-emitting elements in a period, and a light emitting driver operatively coupled to the active region and configured to cause the plurality of light-emitting elements to emit light in the period.

In another example, an apparatus for display includes an active region having a plurality of light-emitting elements, and a light emitting driver operatively coupled to the active region. The light emitting driver is configured to provide a light emitting signal that causes the plurality of light-emitting elements to emit light in a first period and a second period. The light emitting signal includes a light emitting enable signal that scans the plurality of light-emitting elements at a first scanning rate in the first period and a second scanning rate in the second period. The first scanning rate is higher than or equal to the second scanning rate. Of the light emitting enable signal, a width of a pulse signal in a frame in the first period is different from a width of another pulse signal in a frame in the second period.

In still another example, a method for driving a plurality of light-emitting elements on a display panel is provided. The method includes scanning the plurality of light-emitting elements in a first period, causing the plurality of light-emitting elements to emit light based on a data signal in the first period, and retaining the data signal. The method may further include scanning the plurality of light-emitting elements in a second period, and causing the plurality of light-emitting elements to emit light based on the data signal in the second period.

BRIEF DESCRIPTION OF THE DRAWINGS

The accompanying drawings, which are incorporated herein and form part of the specification, illustrate the presented disclosure and, together with the description, further serve to explain the principles of the disclosure and enable a person of skill in the relevant art(s) to make and use the disclosure.

Figure 1:
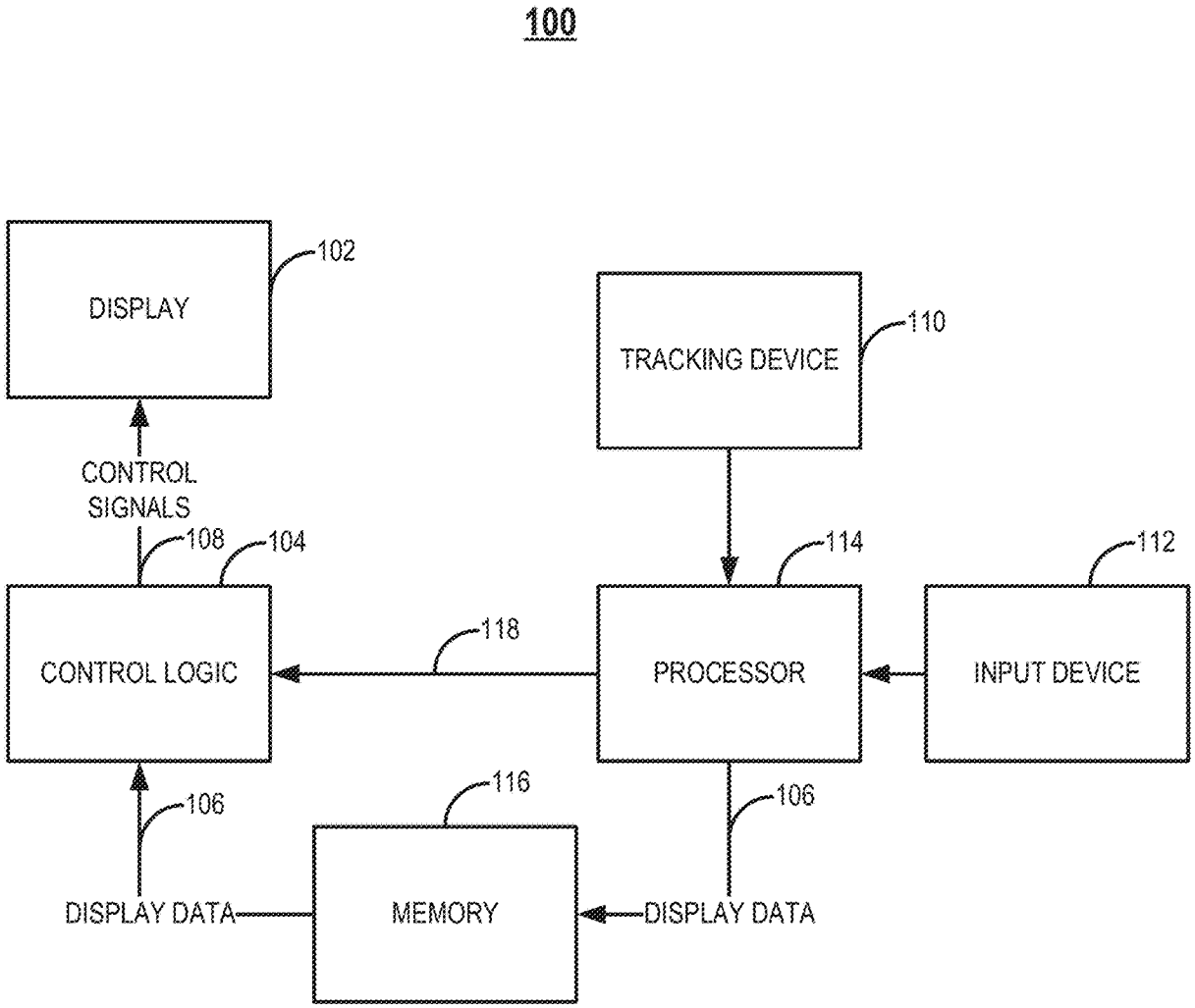
FIG. 1 is a block diagram illustrating an apparatus including a display and control logic in accordance with an embodiment.

The presented disclosure is described with reference to the accompanying drawings. In the drawings, generally, like reference numbers indicate identical or functionally similar elements. Additionally, generally, the left-most digit(s) of a reference number identifies the drawing in which the reference number first appears.

DETAILED DESCRIPTION

In the following detailed description, numerous specific details are set forth by way of examples in order to provide a thorough understanding of the relevant disclosures. However, it should be apparent to those skilled in the art that the present disclosure may be practiced without such details. In other instances, well known methods, procedures, systems, components, and/or circuitry have been described at a relatively high-level, without detail, in order to avoid unnecessarily obscuring aspects of the present disclosure.

Throughout the specification and claims, terms may have nuanced meanings suggested or implied in context beyond an explicitly stated meaning. Likewise, the phrase "in one embodiment/example" as used herein does not necessarily refer to the same embodiment and the phrase "in another embodiment/example" as used herein does not necessarily refer to a different embodiment. It is intended, for example, that claimed subject matter include combinations of example embodiments in whole or in part.

In general, terminology may be understood at least in part from usage in context. For example, terms, such as "and," "or," or "and/or," as used herein may include a variety of meanings that may depend at least in part upon the context in which such terms are used. Typically, "or" if used to associate a list, such as A, B or C, is intended to mean A, B, and C, here used in the inclusive sense, as well as A, B or C, here used in the exclusive sense. In addition, the term "one or more" as used herein, depending at least in part upon context, may be used to describe any feature, structure, or characteristic in a singular sense or may be used to describe combinations of features, structures or characteristics in a plural sense. Similarly, terms, such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

Active-matrix organic light-emitting diode (AMOLED) technology has been used widely in various display devices such as mobile phones, computers, TVs, and VA/AR devices. AMOLED displays often have advantages such as low-power and fast response. In operation, the active area of an AMOLED display, having an array of OLEDs, is often driven by a gate scanning signal and an emission scanning signal to allow the OLEDs to emit light at desired times and desired brightness. Power consumption of the AMOLED display can be directly related to the scanning rates of the gate scanning signal and the emission scanning signal. To save energy, the scanning scheme of an AMOLED display can be modified to allow the AMOLED display to be operated under a normal mode and a power-saving mode. Under normal mode, gate scanning signal and emission scanning signal each scans the active area of the AMOLED at a respective normal (non-reduced) scanning rate. Under power-saving mode, the scanning rates of gate scanning signal and/or emission scanning signal can be reduced. Under both normal mode and power-saving mode, data signals are inputted into the active area to allow the OLEDs in the active area to emit light in accordance with the data signals in each frame. However, it is desired that the power consumption of the active area in an AMOLED display be further reduced.

As will be disclosed in detail below, among other novel features, the display system, apparatus, and method in the present disclosure can reduce the power consumption of an OLED display when the displayed images are still images and/or slow-moving images. When starting to display still and/or slow-moving images, the OLED display enters into a power saving mode, e.g., from a normal mode. Under the power saving mode, at least one of gate scanning driver, light emitting driver, and source writing driver of the OLED display provide a signal that has a scanning rate lower than that under the normal mode. In some embodiments, under the power saving mode, the source writing driver provides no source signal, and the gate scanning driver provides no gate scanning enable signal and no gate scanning clock signal. The frame rate under the power saving mode may be the same or lower than that under the normal mode. The light emitting driver may provide a light emitting enable signal that has one or more pulse signals, each in a respective frame under the power saving mode, with widths the same as or different from those under the normal mode. In some embodiments, if the widths of the pulse signals are different from those under the normal mode, the widths of the pulse signals may decrease with time such that the luminance in each of the frames is nominally the same as one another. In some embodiments, the luminance under the normal mode and the luminance under the power saving mode may be nominally the same. In some embodiments, the number of pulse signals (or frames under the power saving mode) is equal to or less than 4.

In some other embodiments, a frame rate under the power saving mode is lower than a frame rate under the normal mode. The data signal, the gate scanning enable signal, and the light emitting enable signal may have a scanning rate the same as the frame rate under the power saving mode. In some embodiments, the light emitting enable signal has one or more pulse signals, each in a respective frame under the power saving mode, with widths different from those under the normal mode. In some embodiments, the widths of the pulse signals may decrease with time such that the luminance in each of the frames is nominally the same as one another. In some embodiments, the luminance under the normal mode and the luminance under the power saving mode may be nominally the same.

Additional novel features will be set forth in part in the description which follows, and in part will become apparent to those skilled in the art upon examination of the following and the accompanying drawings or may be learned by production or operation of the examples. The novel features of the present disclosure may be realized and attained by practice or use of various aspects of the methodologies, instrumentalities, and combinations set forth in the detailed examples discussed below.

FIG. 1 illustrates an apparatus 100 including a display 102 and control logic 104. Apparatus 100 may be any suitable device, for example, a VR/AR device (e.g., VR headset, etc.), handheld device (e.g., dumb or smart phone, tablet, etc.), wearable device (e.g., eyeglasses, wrist watch, etc.), automobile control station, gaming console, television set, laptop computer, desktop computer, netbook computer, media center, set-top box, global positioning system (GPS), electronic billboard, electronic sign, printer, or any other suitable device. In this embodiment, display 102 is operatively coupled to control logic 104 and is part of apparatus 100, such as but not limited to, a head-mounted display, computer monitor, television screen, head-up display (HUD), dashboard, electronic billboard, or electronic sign. Display 102 may be an OLED display, micro-OLED display, micro-LED display, liquid crystal display (LCD), E-ink display, electroluminescent display (ELD), billboard display with LED or incandescent lamps, or any other suitable type of display.

Control logic 104 may be any suitable hardware, software, firmware, or a combination thereof, configured to receive display data 106 (e.g., pixel data) and generate control signals 108 for driving the subpixels on display 102. Control signals 108 are used for controlling the writing of display data to the subpixels and directing operations of display 102. For example, subpixel rendering (SPR) algorithms for various subpixel arrangements may be part of control logic 104 or implemented by control logic 104. Control logic 104 may include a data interface and a control signal generating module having a timing controller (TCON) and a clock generator. Control logic 104 may include any other suitable components, such as an encoder, a decoder, one or more processors, controllers, and storage devices. Control logic 104 may be implemented as a standalone integrated circuit (IC) chip, such as an application-specific integrated circuit (ASIC) or a field-programmable gate array (FPGA). In some embodiments, control logic 104 may be manufactured in a chip-on-glass (COG) package, for example, when display 102 is a rigid display. In some embodiments, control logic 104 may be manufactured in a chip-on-film (COF) package, for example, when display 102 is a flexible display, e.g., a flexible OLED display. In some embodiments, control logic 104 may be manufactured in a chip-on-plastic (COP) package.

Apparatus 100 may also include any other suitable component such as, but not limited to tracking devices 110 (e.g., inertial sensors, camera, eye tracker, GPS, or any other suitable devices for tracking motion of eyeballs, facial expression, head movement, body movement, and hand gesture) and input devices 112 (e.g., a mouse, keyboard, remote controller, handwriting device, microphone, scanner, etc.).

In this embodiment, apparatus 100 may be a handheld or a VR/AR device, such as a smart phone, a tablet, or a VR headset. Apparatus 100 may also include a processor 114 and memory 116. Processor 114 may be, for example, a graphics processor (e.g., graphics processing unit (GPU)), an application processor (AP), a general processor (e.g., APU, accelerated processing unit; GPGPU, general-purpose computing on GPU), or any other suitable processor. Memory 116 may be, for example, a discrete frame buffer or a unified memory. Processor 114 is configured to generate display data 106 in consecutive display frames and may temporally store display data 106 in memory 116 before sending it to control logic 104. Processor 114 may also generate other data, such as but not limited to, control instructions 118 or test signals and provide them to control logic 104 directly or through memory 116. Control logic 104 then receives display data 106 from memory 116 or directly from processor 114.

Figure 2A:
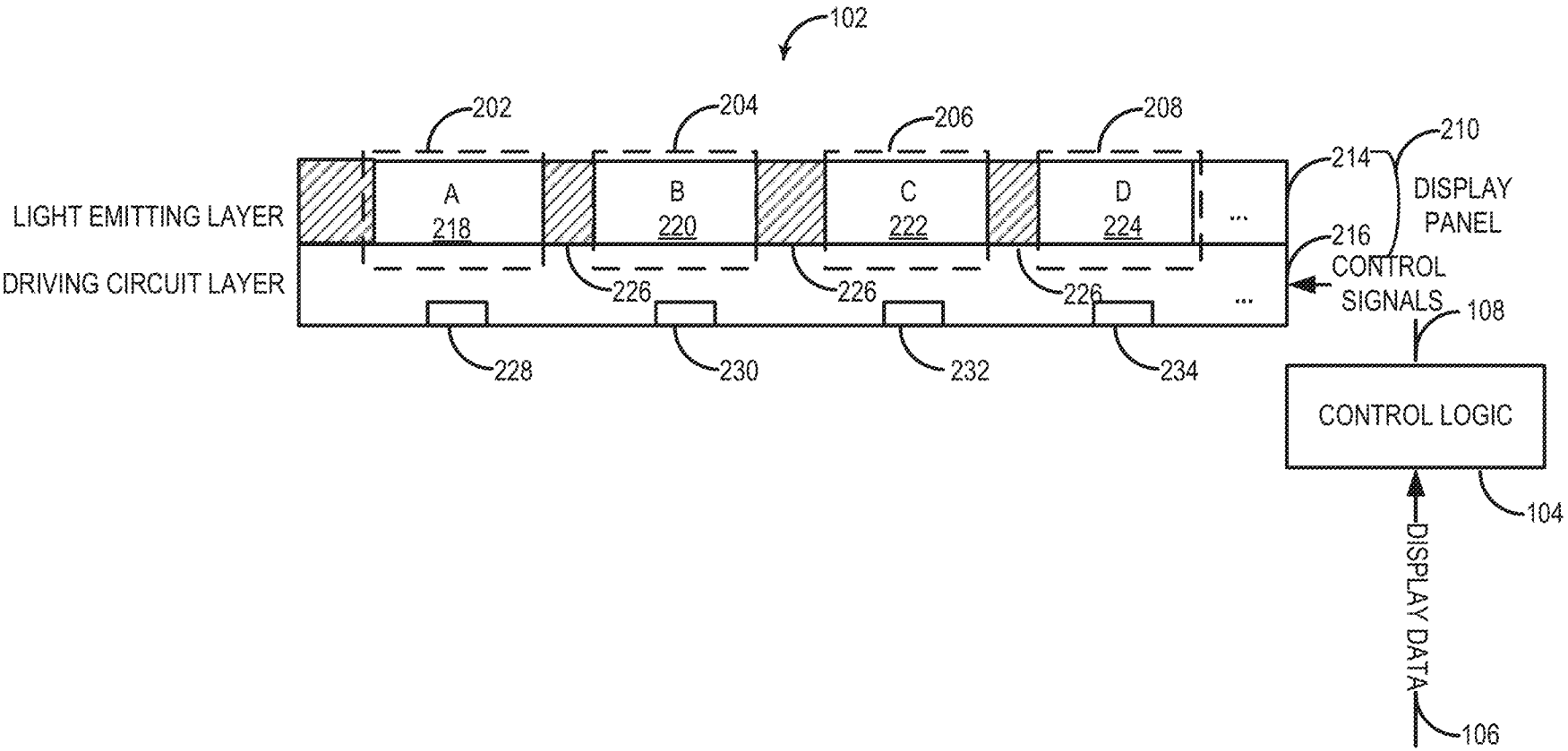
FIGS. 2A-2C are side-view diagrams illustrating various examples of the display shown in FIG. 1 in accordance with various embodiments.

FIG. 2A is a side-view diagram illustrating one example of display 102 including subpixels 202, 204, 206, and 208. Display 102 may be any suitable type of display, for example, OLED displays, such as an active-matrix OLED (AMOLED) display, or any other suitable display. Display 102 may include a display panel 210 operatively coupled to control logic 104. The example shown in FIG. 2A illustrates a side-by-side (a.k.a. lateral emitter) OLED color patterning architecture in which one color of light-emitting material is deposited through a metal shadow mask while the other color areas are blocked by the mask.

In this embodiment, display panel 210 includes light emitting layer 214 and a driving circuit layer 216. As shown in FIG. 2A, light emitting layer 214 includes a plurality of light-emitting elements (e.g., OLEDs) 218, 220, 222, and 224, corresponding to a plurality of subpixels 202, 204, 206, and 208, respectively. A, B, C, and D in FIG. 2A denote OLEDs in different colors, such as but not limited to, red, green, blue, yellow, cyan, magenta, or white. Light emitting layer 214 also includes a black array 226 disposed between OLEDs 218, 220, 222, and 224, as shown in FIG. 2A. Black array 226, as the borders of subpixels 202, 204, 206, and 208, is used for blocking light coming out from the parts outside OLEDs 218, 220, 222, and 224. Each OLED 218, 220, 222, and 224 in light emitting layer 214 can emit light in a predetermined color and brightness.

In this embodiment, driving circuit layer 216 includes a plurality of pixel circuits 228, 230, 232, and 234, each of which includes one or more thin film transistors (TFTs), corresponding to OLEDs 218, 220, 222, and 224 of subpixels 202, 204, 206, and 208, respectively. Pixel circuits 228, 230, 232, and 234 may be individually addressed by control signals 108 from control logic 104 and configured to drive corresponding subpixels 202, 204, 206, and 208, by controlling the light emitting from respective OLEDs 218, 220, 222, and 224, according to control signals 108. Driving circuit layer 216 may further include one or more drivers (not shown) formed on the same substrate as pixel circuits 228, 230, 232, and 234. The on-panel drivers may include circuits for controlling light emitting, gate scanning, and data writing, as described below in detail. Scan lines and data lines are also formed in driving circuit layer 216 for transmitting scan signals and data signals, respectively, from the drivers to each pixel circuit 228, 230, 232, and 234. Display panel 210 may include any other suitable component, such as one or more glass substrates, polarization layers, or a touch panel (not shown). Pixel circuits 228, 230, 232, and 234 and other components in driving circuit layer 216 in this embodiment are formed on a low temperature polycrystalline silicon (LTPS) layer deposited on a glass substrate, and the TFTs in each pixel circuit 228, 230, 232, and 234 are p-type transistors (e.g., PMOS LTPS-TFTs). In some embodiments, the components in driving circuit layer 216 may be formed on an amorphous silicon (a-Si) layer, and the TFTs in each pixel circuit may be n-type transistors (e.g., NMOS TFTs). In some embodiments, the TFTs in each pixel circuit may be organic TFTs (OTFT) or indium gallium zinc oxide (IGZO) TFTs.

As shown in FIG. 2A, each subpixel 202, 204, 206, and 208 is formed by at least an OLED 218, 220, 222, and 224 driven by a corresponding pixel circuit 228, 230, 232, and 234. Each OLED may be formed by a sandwich structure of an anode, an organic light-emitting layer, and a cathode. Depending on the characteristics (e.g., material, structure, etc.) of the organic light-emitting layer of the respective OLED, a subpixel may present a distinct color and brightness. Each OLED 218, 220, 222, and 224 in this embodiment is a top-emitting OLED. In some embodiments, the OLED may be in a different configuration, such as a bottom-emitting OLED. In one example, one pixel may consist of three subpixels, such as subpixels in the three primary colors (red, green, and blue) to present a full color. In another example, one pixel may consist of four subpixels, such as subpixels in the three primary colors (red, green, and blue) and the white color. In still another example, one pixel may consist of two subpixels. For example, subpixels A 202 and B 204 may constitute one pixel, and subpixels C 206 and D 208 may constitute another pixel. Here, since display data 106 is usually programmed at the pixel level, the two subpixels of each pixel or the multiple subpixels of several adjacent pixels may be addressed collectively by SPRs to present the appropriate brightness and color of each pixel, as designated in display data 106 (e.g., pixel data). However, it is to be appreciated that, in some embodiments, display data 106 may be programmed at the subpixel level such that display data 106 can directly address individual subpixel without SPRs. Because it usually requires three primary colors to present a full color, specifically designed subpixel arrangements may be provided for display 102 in conjunction with SPR algorithms to achieve an appropriate apparent color resolution.

Figure 2B:
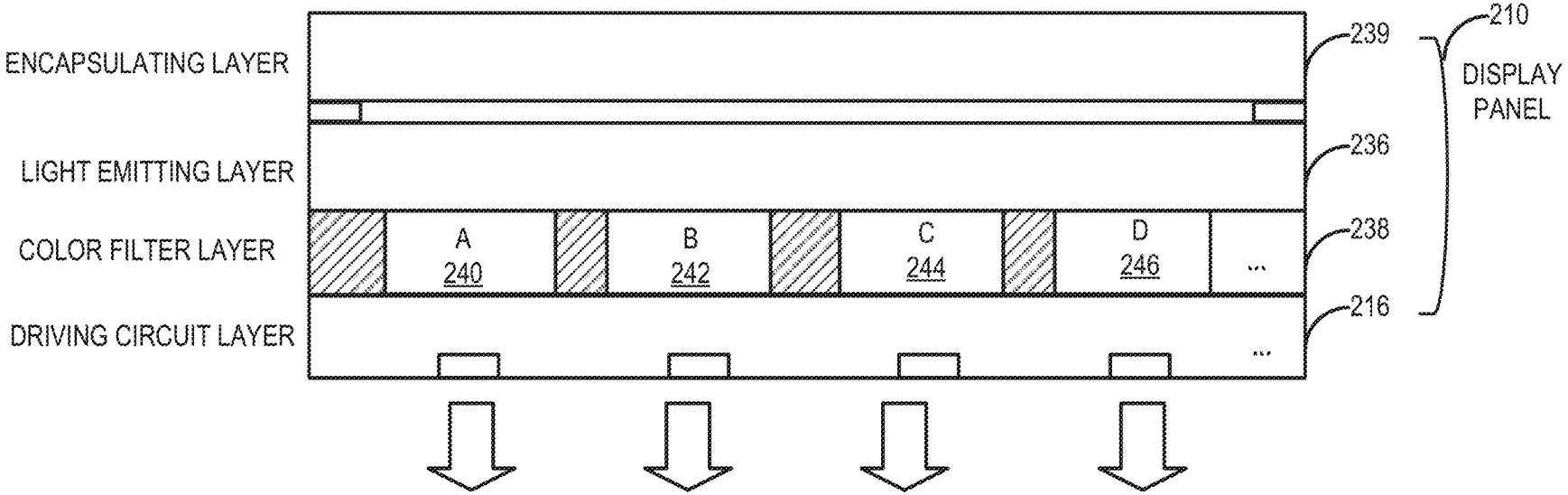

The example shown in FIG. 2A illustrates a side-by-side patterning architecture in which one color of light-emitting material is deposited through the metal shadow mask while the other color areas are blocked by the mask. In another example, a white OLEDs with color filters (WOLED+CF) patterning architecture can be applied to display panel 210. In the WOLED+CF architecture, a stack of light-emitting materials form light emitting layer of the white light. The color of each individual subpixel is defined by another layer of color filters in different colors. As the organic light-emitting materials do not need to be patterned through the metal shadow mask, the resolution and display size can be increased by the WOLED+CF patterning architecture. FIG. 2B illustrates an example of a WOLED+CF patterning architecture applied to display panel 210. Display panel 210 in this embodiment includes driving circuit layer 216, light emitting layer 236, a color filter layer 238, and an encapsulating layer 239. In this example, light emitting layer 236 includes a stack of light emitting sub-layers and emits the white light. Color filter layer 238 may be comprised of a color filter array having a plurality of color filters 240, 242, 244, and 246 corresponding to subpixels 202, 204, 206, and 208, respectively. A, B, C, and D in FIG. 2B denote four different colors of filters, such as but not limited to, red, green, blue, yellow, cyan, magenta, or white. Color filters 240, 242, 244, and 246 may be formed of a resin film in which dyes or pigments having the desired color are contained. Depending on the characteristics (e.g., color, thickness, etc.) of the respective color filter, a subpixel may present a distinct color and brightness. Encapsulating layer 239 may include an encapsulating glass substrate or a substrate fabricated by the thin film encapsulation (TFE) technology. Driving circuit layer 216 may be comprised of an array of pixel circuits including LTPS, IGZO, or OTFT transistors. Display panel 210 may include any other suitable components, such as polarization layers, or a touch panel (not shown).

Figure 2C:
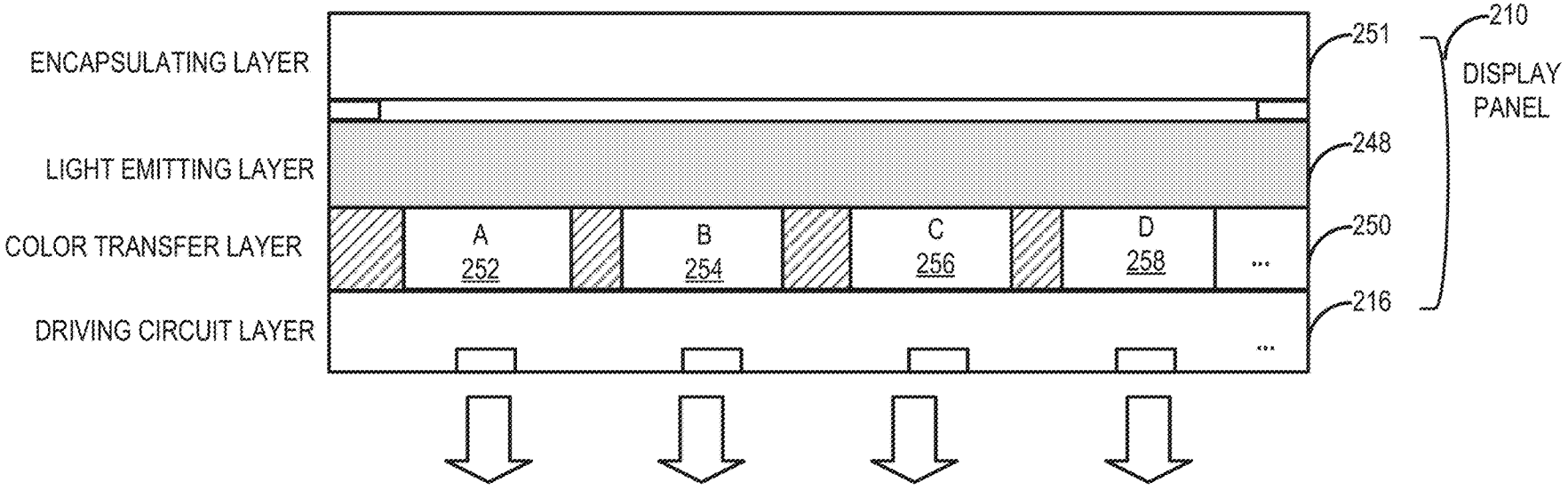

In still another example, a blue OLEDs with transfer color filters (BOLED+transfer CF) patterning architecture can be applied to display panel 210 as well. In the BOLED+transfer CF architecture, light-emitting material of blue light is deposited without a metal shadow mask, and the color of each individual subpixel is defined by another layer of transfer color filters for different colors. FIG. 2C illustrates an example of a BOLED+transfer CF patterning architecture applied to display panel 210. Display panel 210 in this embodiment includes driving circuit layer 216, light emitting layer 248, a color transfer layer 250, and an encapsulating layer 251. Light emitting layer 248 in this embodiment emits the blue light and can be deposited without a metal shadow mask. It is to be appreciated that in some embodiments, light emitting layer 248 may emit other colors of light. Color transfer layer 250 may be comprised of a transfer color filters array having a plurality of transfer color filters 252, 254, 256, and 258 corresponding to subpixels 202, 204, 206, and 208, respectively. A, B, C, and D in FIG. 2C denote four different colors of transfer color filters, such as but not limited to, red, green, blue, yellow, cyan, magenta, or white. Each type of transfer color filter may be formed of a color changing material. Depending on the characteristics (e.g., color, thickness, etc.) of the respective transfer color filter, a subpixel may present a distinct color and brightness. Encapsulating layer 251 may include an encapsulating glass substrate or a substrate fabricated by the TFE technology. Driving circuit layer 216 may be comprised of an array of pixel circuits including LTPS, IGZO, or OTFT transistors. Display panel 210 may include any other suitable component, such as polarization layers, or a touch panel (not shown).

The display panel driving scheme disclosed herein is suitable for any known OLED patterning architectures, including but not limited to, the side-by-side, WOLED+CF, and BOLED+CCM patterning architectures as described above. Although FIGS. 2A-2C are illustrated as an OLED display, it is to be appreciated that they are provided for an exemplary purpose only and without limitations. In some embodiments, the display panel driving scheme disclosed herein may be applied to micro-LED displays in which each subpixel includes a micro-LED. In some embodiments, the display panel driving scheme disclosed herein may be applied to micro-OLED displays in which each subpixel includes a micro-OLED. The display panel driving scheme disclosed herein may be applied to any other suitable displays in which each subpixel includes a light-emitting element.

Figure 3:
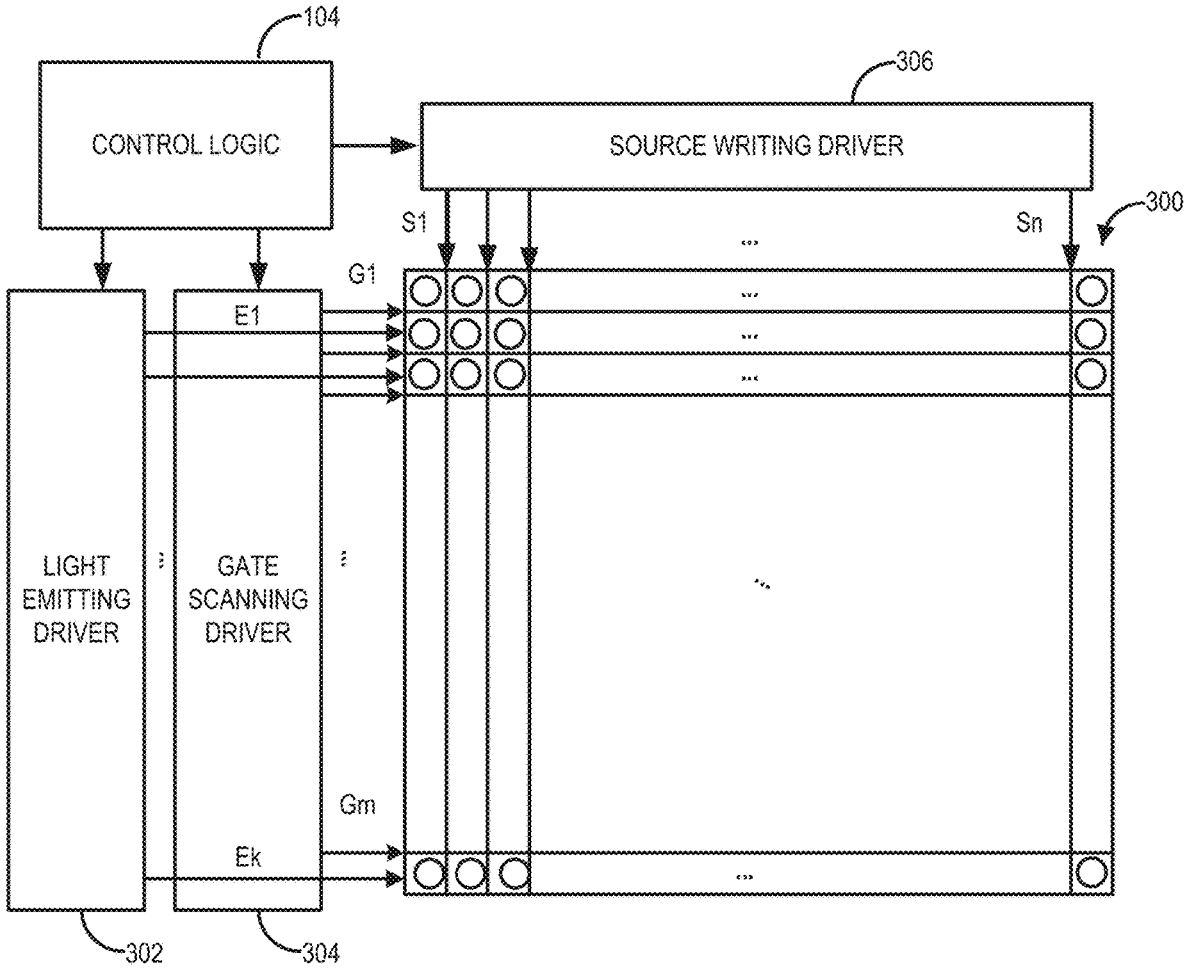
FIG. 3 is a block diagram illustrating the display shown in FIG. 1 including multiple drivers in accordance with an embodiment.

FIG. 3 is a block diagram illustrating display 102 shown in FIG. 1 including multiple drivers in accordance with an embodiment. Display 102 in this embodiment includes an active region 300 having a plurality of subpixels (e.g., each including an OLED, a micro-OLED, or a micro-LED), a plurality of pixel circuits (not shown), and multiple on-panel drivers including light emitting driver 302, a gate scanning driver 304, and a source writing driver 306. Light emitting driver 302, gate scanning driver 304, and source writing driver 306 are operatively coupled to control logic 104 and configured to drive the subpixels in active region 300 based on control signals 108 provided by control logic 104.

In this embodiment, control logic 104 is an integrated circuit (but may alternatively include a state machine made of discrete logic and other components), which provides an interface function between processor 114/memory 116 and display 102. Control logic 104 may provide various control signals 108 with suitable voltage, current, timing, and demultiplexing, to control display 102 to show the desired text or image. Control logic 104 may be an application-specific microcontroller and may include storage units such as RAM, flash memory, EEPROM, and/or ROM, which may store, for example, firmware and display fonts. In this embodiment, control logic 104 includes a data interface and a control signal generating module 504. The data interface may be any serial or parallel interface, such as but not limited to, display serial interface (DSI), display pixel interface (DPI), and display bus interface (DBI) by the Mobile Industry Processor Interface (MIPI) Alliance, unified display interface (UDI), digital visual interface (DVI), high-definition multimedia interface (HDMI), and DisplayPort (DP). Data interface 502 in this embodiment is configured to receive display data 106 and any other control instructions 118 or test signals from processor 114/memory 116. Display data 106 may be received in consecutive frames at any frame rate, such as 30, 60, 72, 90, 120, or 180 frames per second (fps). The received display data 106 is forwarded by the data interface to the control signal generating module.

In this embodiment, the control signal generating module provides control signals 108 to on-panel drivers 302, 304, and 306. Control signals 108 control on-panel drivers 302, 304, and 306 to drive the subpixels in active region 300 by, in each frame, scanning the subpixels to update display data and causing the subpixels to emit light to present the updated display image. The control signal generating module may include a TCON and a clock generator. The TCON may provide a variety of enable signals (STV), including but not limited to, a first set of enable signals (e.g., gate scanning enable signals) to gate scanning driver 304 and a second set of enable signals (light emitting enable signals) to light emitting driver 302. The clock generator may provide a variety of clock signals (CLK), including but not limited to, a first set of clock signals (e.g., gate scanning clock signals) to gate scanning driver 304 and a second set of clock signals (e.g., light emitting clock signals) to light emitting driver 302.

Figure 4A:
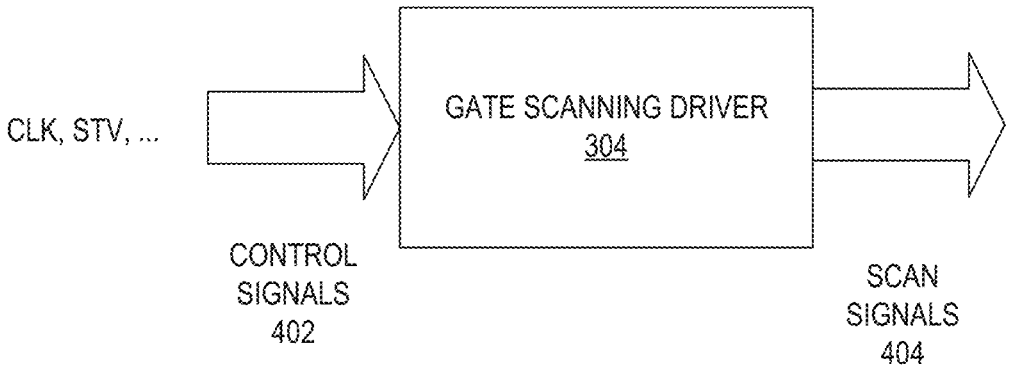
FIGS. 4A and 4B are depictions of an example of input and output signals of the light emitting driver and gate scanning driver, respectively, shown in FIG. 2 in accordance with an embodiment.

For example, as shown in FIG. 4A, the control signal generating module may provide a first set of control signals 402, including but not limited to, the first set of enable signals (e.g., gate scanning enable signals) and the first set of clock signals (e.g., gate scanning clock signals), to gate scanning driver 304 to control gate scanning driver 304 to generate scan signals 404 for scanning the subpixels in active region 300 at a gate scanning rate in each frame. The control signal generating module may also provide a second set of control signals 406, including but not limited to, the second set of enable signals (e.g., light emitting enable signals) and the second set of clock signals (e.g., light emitting clock signals), to light emitting driver 302 to control light emitting driver 302 to generate emission signals 408 for causing the subpixels in active region 300 to emit light at light emitting rate in each frame. The details of the timing of each control signal 108 provided by the control signal generating module are described below in accordance with various embodiments of the present disclosure.

Referring back to FIG. 3, active region 300 may be the entire region of the display panel including all the subpixels arranged thereon. In some embodiments, active region 300 may be any portion of the entire display panel region and include subpixels in the corresponding region. In some embodiments, the display panel may be divided into multiple zones, and active region 300 may be one or more of the zones and include the corresponding subpixels in the zone(s). It is to be appreciated that a display panel may include a display region and a porch region. Light-emitting elements in the display region can present content of display images based on display data 106, while light-emitting elements in the porch region may emit light but not present any content of display images (not involved in display update). For ease of description, active region 300 refers thereafter to the entire display region with all the subpixels in the display region arranged in rows and columns. That is, the subpixels in active region 300 may include a plurality of rows of subpixels (lines).

Figure 5:
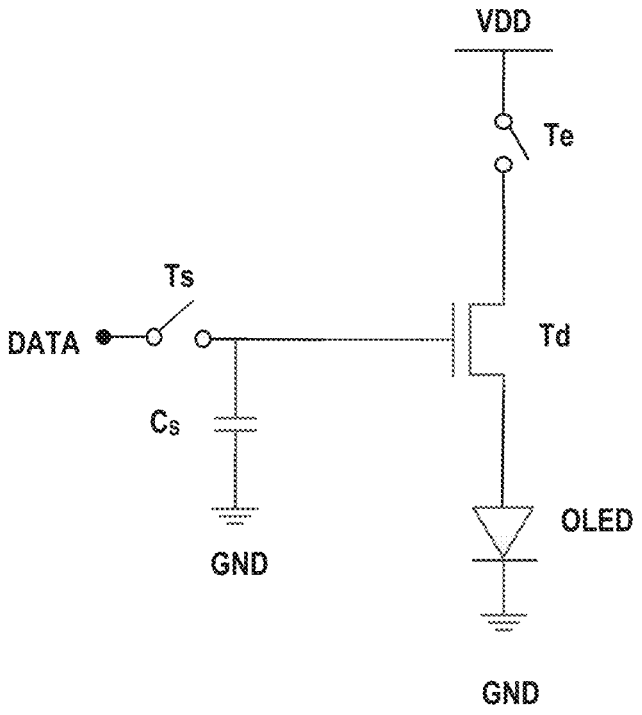
FIG. 5 is a depiction of a pixel circuit used in the OLEDs in a display in accordance with an embodiment.

Each subpixel in active region 300 may be a light-emitting element that can be individually addressed, such as an OLED, a micro-OLED, or a micro-LED. In some embodiments in which display 102 is an OLED display, each subpixel may include an OLED, such as a top emitting OLED, and a pixel circuit for driving the OLED. Each OLED can emit light in a predetermined brightness and color, such as but not limited to, red, green, blue, yellow, cyan, magenta, or white. Each pixel circuit includes TFTs and is configured to drive the corresponding subpixel by controlling the light emitted from the respective OLED according to control signals 108 from control logic 104. The pixel circuit may be in a 3T1C configuration (i.e., including a switching transistor Ts, a driving transistor Td, and light emitting transistor Te, and a storage capacitor C) or may include a compensation circuit (not shown) with more transistors and/or capacitors for brightness uniformity, such as in a 7T1C, 5T1C, 5T2C, or 6T1C configuration. FIG. 5 illustrates a subpixel 500 in active region 300 of the present disclosure. As an example, subpixel 500 includes an OLED, a driving transistor Td operatively coupled to the OLED, a light emitting transistor Te operatively coupled to driving transistor Td, a storage capacitor Cs operatively coupled to the driving transistor Td, and a switching transistor Ts operatively coupled to driving transistor Td and storage capacitor Cs. An anode of the OLED may be operatively coupled to driving transistor Td, and a cathode of the OLED may be grounded. Driving transistor Td may be operatively coupled to a voltage supply VDD through light emitting transistor Te, and a data signal DATA through switching transistor Ts. Data signal DATA may include display data 106 and be provided by source writing driver 306. The gate scanning signal and light emitting signal of subpixel 500 are not shown for ease of illustration. In each frame, subpixel 500 may be enabled/controlled by the respective gate scanning signal and light emitting signal to receive data signal DATA and emit light accordingly.

Gate scanning driver 304, e.g., a gate driver on array (GOA), in this embodiment sequentially applies a plurality of scan signals 404, which are generated based on control signals 402 (e.g., the gate scanning enable signals and the gate scanning clock signals), to the scan lines (a.k.a. gate lines) for each row of subpixels in active region 300 in a gate scanning period of each frame at a gate scanning rate. Scan signals 404 may be applied to the gate electrode of the switching transistor Ts of each pixel circuit during the gate scanning period to turn on the switching transistor Ts so that the display data 106 for the corresponding subpixel can be written by source writing driver 306. For example, scan signals 404 may turn on the switching transistor Ts to cause the storage capacitor Cs to be charged at a respective level of the display data signal for the respective OLED. As will be described below in detail, the timings of the gate scanning enable signals and the gate scanning clock signals can determine the gate scanning period of each frame and the gate scanning rate as well. To ensure writing of the correct display data 106 in each gate scanning clock period, each scan line is connected to one row of subpixels. In each gate scanning clock period (e.g., determined by the clock frequency of the gate scanning clock signals), one row of subpixels are scanned. Thus, the gate scanning rate may be determined by the gate scanning clock frequency.

Light emitting driver 302, e.g., an emission driver on array (EOA), in this embodiment sequentially, applies a plurality of emission signals 408, which are generated based on control signals 406 (e.g., the light emitting enable signals and light emitting clock signals), to the emission lines for each row of subpixels in active region 300 in light emitting period of each frame at light emitting rate. Light emitting driver 302 may include one or more shift registers for generating emission signals 408. Emission signals 408 provided by light emitting driver 302 may be applied to the gate electrode of the light emitting transistor Te of each pixel circuit during the light emitting period of each frame to turn on the light emitting transistor Te. In the light emitting period (i.e., when the light emitting transistor Te is turned on), the driving transistor Td may provide a driving current to the OLED at a level determined based on the voltage level currently at the storage capacitor Cs. That is, by turning on the light emitting transistor Te of a subpixel, light emitting driver 302 may cause the OLED of the subpixel to start emitting light. The OLED may keep emitting the light until the corresponding light emitting transistor Te is turned off by light emitting driver 302. As will be described below in detail, the timings of the light emitting enable signals and the light emitting clock signals can determine the light emitting period of each frame, the light emitting rate, and the number of rows of subpixels that can simultaneously emit light. Each emission line may be connected to one row of subpixels. In each light emitting clock period (e.g., determined by the clock frequency of the light emitting clock signals), one row of subpixels may be caused to start emitting light. In some embodiments, each emission line is connected to two rows of subpixels. In each light emitting clock period, two rows of subpixels may be caused to start emitting light. It is to be appreciated that the number of subpixels that can start emitting light in each light emitting clock period may vary in different examples. Thus, the light emitting rate may be determined by the light emitting clock frequency and/or the number of rows of subpixels that are caused to start emitting light in each light emitting clock period.

Source writing driver 306 in this embodiment is configured to write display data 106 received from control logic 104 the subpixels in active region 300 in each frame. For example, source writing driver 306 may simultaneously apply display data signals to the data lines (a.k.a. source lines) for each column of subpixels. That is, source writing driver 306 may include one or more shift registers, digital-analog converter (DAC), multiplexers (MUX), and arithmetic circuit for controlling a timing of application of voltage to the source electrode of the switching transistor Ts of each pixel circuit and magnitude of the applied voltage according to gradations of display data 106 in the gate scanning period of each frame. That is, the display update in each frame is synchronized with the gate scan as the corresponding display data 106 of each row of subpixels is written to the row of subpixels when the row of subpixels are scanned. Thus, source writing driver 306 may update display data 106 in each frame at a rate that is the same as the gate scanning rate.

Figure 4B:
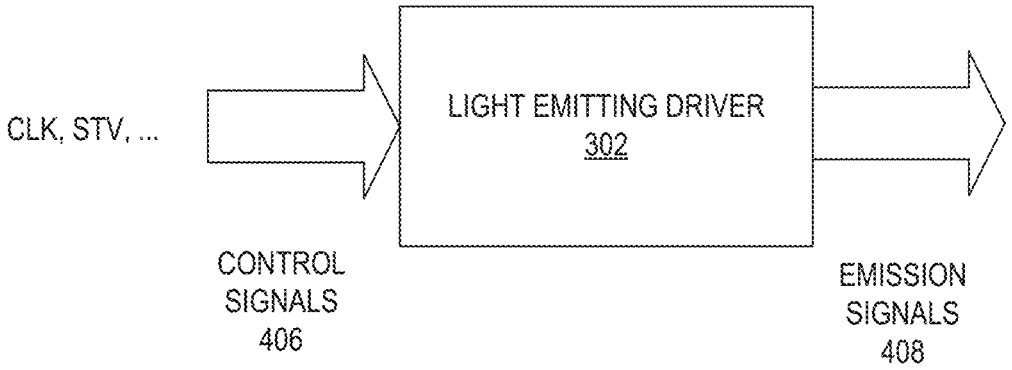

It is to be appreciated that although one light emitting driver 302 is illustrated in FIGS. 3 and 4B, in some embodiments, multiple light emitting drivers may work in conjunction with each other. Similarly, in some embodiments, multiple gate scanning drivers and/or source writing drivers may work in conjunction with each other. It is also to be appreciated that in some embodiments, light emitting driver 302, gate scanning driver 304, and/or source writing driver 306 may not be on-panel drivers, i.e., not parts of the display panel, but instead are operatively coupled to the display panel.

Figure 6A:
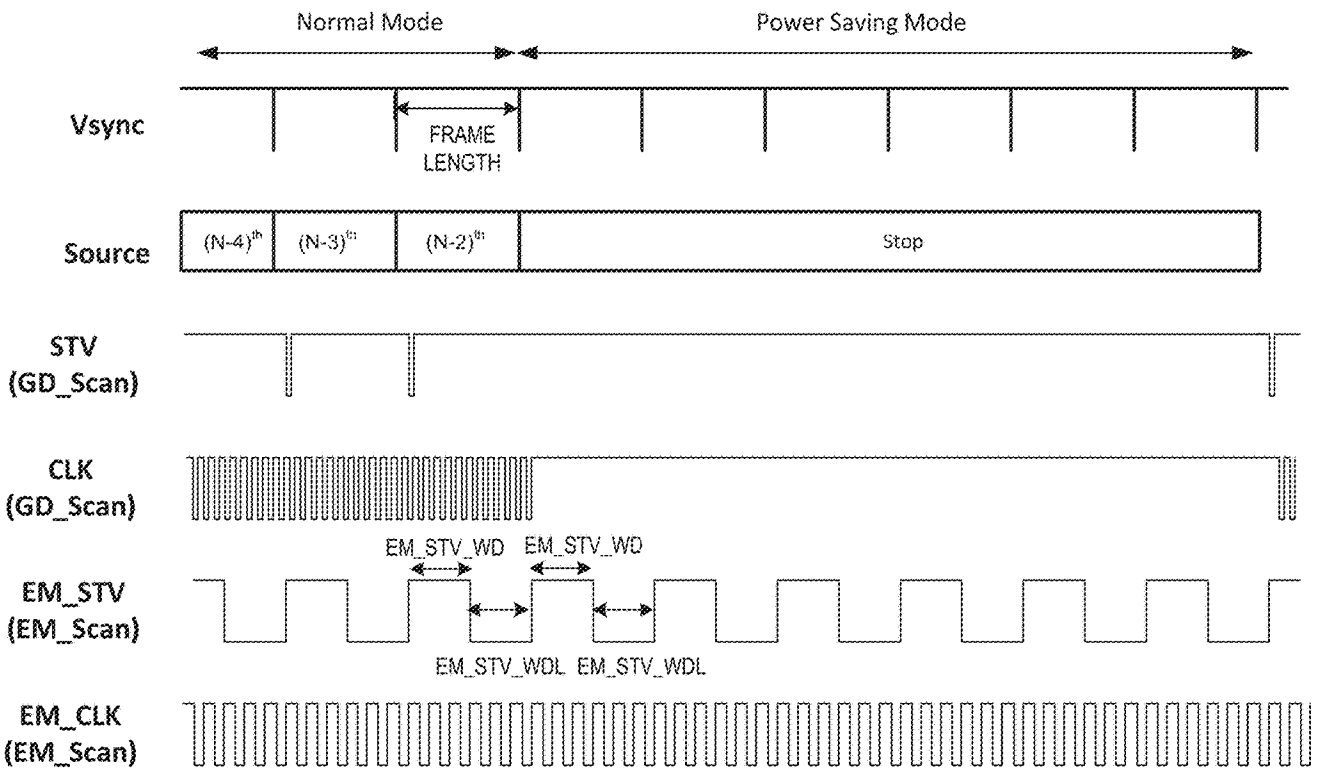
FIGS. 6A-6C each illustrates an exemplary method for driving a plurality of OLEDs in a display in accordance with an embodiment.

FIG. 6A is a timing diagram illustrating a driving scheme 600 of display 102 under a normal mode and a power saving mode, according to some embodiments. Using driving scheme 600, display 102 consumes less energy operating under the power saving mode, compared to the normal mode. The vertical synchronization (Vsync) signal defines consecutive frames by signifying the start of each new frame with a low voltage level. The frame rate defined by the Vsync signal may be the same as the standard refresh rate of the display panel (i.e., the normal frame rate). The source signal defines a period in which the display data of each frame is updated by source writing driver 306. As described above, the display update period may be the same as the gate scanning period of each frame in which the subpixels in active region 300 are scanned by gate scanning driver 304. For example, the display update/gate scanning period may be about 80% of the frame period. For a display panel having a refresh rate of 90 Hz, the frame length is about 11.1 milliseconds (ms), and the display update/gate scanning period may be about 9 ms. The light emitting period may then be about 20% of the frame length.

The gate scanning enable signal STV (GD_Scan) and gate scanning clock signal CLK (GD_Scan) may define the gate scanning rate in each frame. The light emitting enable signal EM_STV (EM_Scan) and light emitting clock signal EM_CLK (EM_Scan) may define the light emitting rate in each frame. As shown in FIG. 6A, display 102 may be refreshed under a respective frame rate under the normal mode and the power saving mode. Under the normal mode, data signal, depicted as "Source" in FIG. 6A and provided by source writing driver 306, may be updated in each frame. In various embodiments, display 102 can be operated under power saving mode when data signals can be updated at a lower rate, e.g., a rate lower than that in the normal mode or even zero. For example, when display 102 displays still images or a slow-moving motion (e.g., a user is browsing a webpage such that the images displayed on display 102 have little or no change in a period of time), control logic 104 and/or processor 114 may determine display 102 to be operated under the power saving mode.

As shown in FIG. 6A, display 102 can be operated under power saving mode after being operated under normal mode. Light emitting enable signal EM_STV defines the light emitting period in each frame for all light-emitting elements, and light emitting clock signal EM_CLK determines the total number of columns scanned per line. Under normal mode, gate scanning enable signal STV defines consecutive frames by signifying the start of each new frame with a low voltage level, and gate scanning clock signal CLK defines the total number of lines (e.g., rows) scanned in each frame. Under normal mode, the scanning rate of gate scanning enable signal STV and the scanning rate of light emitting enable signal EM_STV may each be the same as the frame rate. The scanning rate of gate scanning clock signal CLK and the scanning rate of light emitting clock signal EM_CLK may each be a non-zero rate. Under the normal mode, the scanning rate of gate scanning clock signal CLK may be determined based on (e.g., equal to) the number of rows/lines in display 102, and the scanning rate of light emitting clock EM_CLK may be determined based on (e.g., equal to) the number of columns (e.g., pixels) in display 102.

For example, as shown in FIG. 6A, the duration of the normal mode may include a plurality of frames. For ease of illustration, $(N-4)^{th}$ frame, $(N-3)^{th}$ frame, and $(N-2)^{th}$ frame may represent the three frames under the normal mode. The frame rate may be a constant value, e.g., 60 Hz, 90 Hz, etc., such that the frame length of each of $(N-4)^{th}$ frame, $(N-3)^{th}$ frame, and $(N-2)^{th}$ frame may be the same. The scanning rates of gate scanning enable signal STV and light emitting scanning signal EM_STV may each be equal to the frame rate. For example, at the same time of each frame, gate scanning enable signal STV outputs a low voltage level (e.g., a low voltage pulse). The period of the light emitting enable signal, e.g., a periodic signal such as a square wave, may be the same as the frame length, and the duty cycle in each period may be the same. Depending on the resolution of active region 300, e.g., the total number of lines and the total number of columns per line, the scanning rates of gate scanning clock signal CLK and light emitting clock signal EM_CLK may be respectively synchronized with gate scanning enable signal STV and light emitting enable signal EM_STV to ensure all the light-emitting elements can be scanned in each frame. Under the normal mode, data signals can be updated, e.g., inputted into light-emitting elements, in each frame. Light emitting clock signal EM_CLK may scan active region 300 at a scanning rate synchronized with the frame rates under the normal mode and the power saving mode.

In some embodiments, display 102 may be operated under power saving mode after the normal mode. As shown in FIG. 6A, the duration of the power saving mode may include at least one frame. Under the power saving mode, at least one of gate scanning enable signal STV and gate scanning clock signal CLK has a scanning rate of zero in at least one frame. That is, under the power saving mode, gate scanning driver 304 may stop scanning the light-emitting elements with gate scanning enable signal STV and/or gate scanning clock signal CLK. Meanwhile, source writing driver 306 may stop inputting data signal in the at least one frame. In some embodiments, when no data signal is transmitted from source writing driver 306, storage capacitor Cs of each light-emitting element may provide a voltage, determined by the data signal provided by source writing driver 306 in the latest frame, to the respective light-emitting element. That is, in the at least one frame under power saving mode, the data signal of each light-emitting element is not refreshed. Instead, the luminance of the light-emitting element is at least partially determined based on the data signal provided by source writing driver 306 in the latest frame (e.g., the last frame of the normal mode).

In some embodiments, as shown in FIG. 6A, the duration of the power saving mode may include a plurality of frames. Source writing driver 306 may stop providing data signals in at least one of the frames. In some embodiments, source writing driver 306 provides no data signals in all the frames in the power saving mode. In some embodiments, each of gate scanning enable signal STV and gate scanning clock signal CLK has a scanning rate of zero in at least one of the frames under the power saving mode. In some embodiments, each of gate scanning enable signal STV and/or gate scanning clock signal CLK has a scanning rate of zero in all the frames under the power saving mode. Under the power saving mode, the luminance of each light-emitting element may be at least partially depending on the data signal provided in $(N-2)^{th}$ frame, which is the last frame under the normal mode and the latest frame source writing driver 306 provides data signal to the light-emitting elements. For example, the applied voltage of the data signal in $(N-2)^{th}$ frame, provided by source writing driver 306, can be stored in the storage capacitor Cs of each light-emitting element. The luminance of each light-emitting element under the power saving mode may at least be partially determined by the voltage provided by the respective storage capacitor Cs.

In some embodiments, light emitting driver 302 provides light emitting enable signal EM_STV, e.g., a plurality of pulse signals, under the normal mode and the power saving mode. In each frame, light emitting enable signal EM_STV may include at least one period, including a high period and a low period. In the present disclosure, the "pulse signal" in the light emitting enable signal EM_STV refers to the high period or the low period that corresponds to the light emitting period in each frame. For example, the pulse signal refers to a low period if driving transistor Td is a P-type transistor, and refers to a high period if driving transistor Td is an N-type transistor. In some embodiments, a width (i.e., duration) of the pulse signal in each frame under the power saving mode is the same. In some embodiments, the width of the pulse signal in each frame under the power saving mode is the same as that under the normal mode. As an example, driving transistor Td is a P-type transistor, and the width of the pulse signal may be the width of the low period in each frame. In some embodiments, the width of each pulse signal under power saving mode may be the same as that under the normal mode. In some embodiments, still using the P-type transistor as driving transistor Td as an example, the width of each pulse signal under normal mode and under power saving mode may be equal to EM_STV_WDL, which can be any suitable number less than the frame length. In some embodiments, the scanning rate of light emitting enable signal EM_STV is constant under the normal mode and the power saving mode, and the width of the pulse signal (e.g., EM_STV_WDL) is the same in each frame under the normal mode and the power saving mode.

In various embodiments, the frame rates under the normal mode and the power saving mode may be the same or different. In some embodiments, the frame rate under the power saving mode can gradually decrease from the frame rate under the normal mode. For example, the frame length under the power saving mode may start to increase from any one (e.g., the first one) of the plurality of frames under the power saving mode. The frame rate (or frame length) under the power saving mode may be constant or may vary. By stop providing data signal and at least one of gate scanning enable signal STV and gate scanning clock signal CLK in the power saving mode, the power consumption of display 102 can be reduced.

Figure 6B:
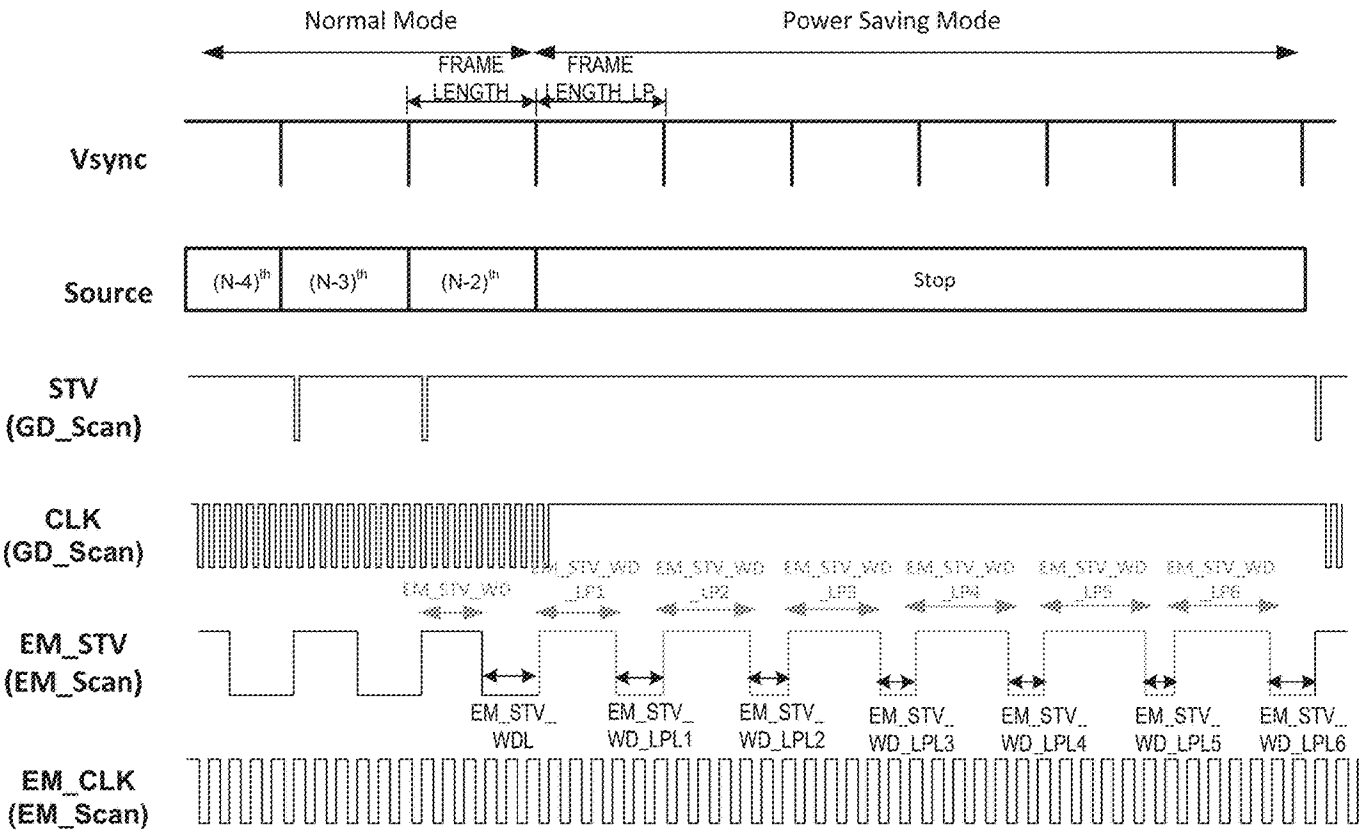

FIG. 6B is another timing diagram illustrating a driving scheme 601 of display 102 under a normal mode and a power saving mode, according to some embodiments. At least one of gate scanning enable signal STV and gate scanning clock signal CLK has a scanning rate of zero under the power saving mode. In some embodiments, as shown in FIG. 6B, gate scanning enable signal STV, gate scanning clock signal CLK, and data signal provide no signal/voltage under the power saving mode. Light emitting clock signal EM_CLK may scan active area 300 at a scanning rate that is synchronized with a frame rate under the normal mode and a frame rate under the power saving mode. Different from driving scheme 600, under power saving mode, for light emitting enable signal EM_STV, a width of a pulse signal in at least one of the frames may be different from that in each frame under the normal mode. In some embodiments, under the power saving mode, the width of the pulse signal in a latter frame is less than the width of a pulse signal in a prior frame. For example, for two adjacent frames under the power saving mode, the width of the pulse signal in the latter frame can be less than that in the prior frame. In some embodiments, the duration of power saving mode includes a plurality of frames, the width of the pulse signal in the frames decreases, e.g., gradually, with time. In some embodiments, because the light emission of a light-emitting element is at least partially dependent on the voltage provided by storage capacitor Cs, the leakage current from storage capacitor Cs may contribute to the luminance of the light-emitting element, causing the actual luminance of the light-emitting element to increase with time and is higher than a desired luminance (e.g., an ideal luminance) that is calculated based on the voltage provided by storage capacitor Cs (e.g., without the contribution from the leakage current). The decreasing width of pulse signal of light emitting enable signal EM_STV in each frame can result in a decreasing light emitting period, balancing/compensating the actual luminance of the light-emitting elements in active region 300 under the power saving mode to be nominally the same as the luminance under the normal mode. In some embodiments, the width of the pulse signal in each frame under the power saving mode is adjusted such that the actual luminance of the light-emitting elements in each frame under the power saving mode is nominally the same as that under the normal mode. In some embodiments, the widths of the pulse signals under the power saving mode decrease exponentially with time. In various embodiments, the widths of the pulse signals under the power saving mode may increase, decrease, and/or stay constant with time such that the luminance in each frame under the power saving mode is nominally the same as that in each frame under the normal mode. In some embodiments, the actual luminance resulted from the light-emitting elements in the frame under the power saving mode is nominally the same as the luminance by the light-emitting elements in each frame under the normal mode.

In some embodiments, as shown in FIG. 6B, the duration of power saving mode may include a plurality of frames. As an example, 6 frames are shown in FIG. 6B. For light emitting enable signal EM_STV, each frame including a period that has a high period and a low period. Under the power saving mode, in each frame, the width of the high period is depicted as EM_STV_WD_LPn, and the width of the low period is depicted as EM_STV_WD_LPLn, where n is equal to 1, 2, 3, 4, 5, and 6. Under the normal mode, in each frame, the width of the high period is depicted as EM_STV_WD, and the width of the low period is depicted as EM_STV_WDL.

Figure 7A:
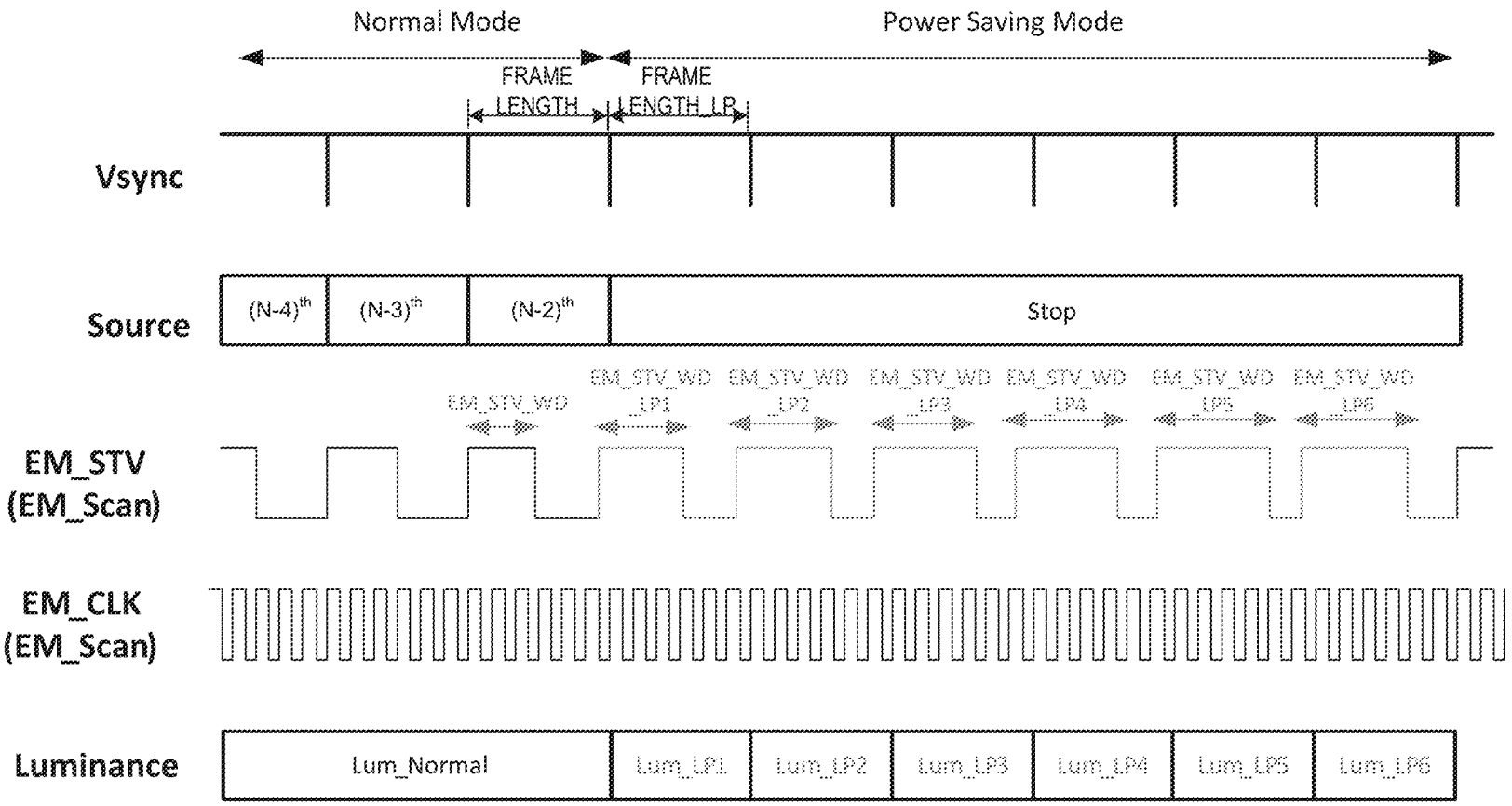
FIGS. 7A and 7B illustrate luminance of the display using the methods shown in FIGS. 6B and 6C, respectively, in accordance with an embodiment.

In some embodiments, driving transistor Td is a P-type transistor, and the width of the pulse signal in light emitting enable signal EM_STV in each frame is the width (e.g., duration) of the low period in the frame. In some embodiments, EM_STV_WDL≥EM_STV_WD_LPL1>EM_STV_WD_LPL2>EM_STV_WD_LPL3>EM_STV_WD_LPL4>EM_STV_WD_LPL5>EM_STV_WD_LPL6. In some embodiments, driving transistor Td is an N-type transistor, and the width of the pulse signal in light emitting enable signal EM_STV in each frame is the width (e.g., duration) of the high period in the frame. In some embodiments, EM_STV_WD≥EM_STV_WD_LP1>EM_STV_WD_LP2>EM_STV_WD_LP3>EM_STV_WD_LP4>EM_STV_WD_LP5>EM_STV_WD_LP6. In some embodiments, as shown in FIG. 7A, the actual luminance of the light-emitting elements during each of the 6 frames under the power saving mode, e.g., depicted as Lum_LP1, Lum_LP2, Lum_LP3, Lum_LP4, Lum_LP5, and Lum_LP6, may be nominally the same as one another. In some embodiments, Lum_LP1, . . . , Lum_LP6 may each be nominally the same as Lum_Normal, which represents the luminance of the light-emitting elements in each frame under the normal mode.

In various embodiments, under power saving mode, due to the differences in display panels, the leakage current from storage capacitor Cs may cause the actual luminance of the light-emitting element to decrease with time and is lower than a desired luminance. In this case, the widths of pulse signals may be controlled to compensate the actual luminance of the light-emitting elements in active region 300 under the power saving mode to be nominally the same as the luminance under the normal mode. Accordingly, in some embodiments, driving transistor Td is a P-type transistor, and EM_STV_WDL≤EM_STV_WD_LPL1<EM_STV_WD_LPL2<EM_STV_WD_LPL3<EM_STV_WD_LPL4<EM_STV_WD_LPL5<EM_STV_WD_LPL6. Also, in some embodiments, driving transistor Td is an N-type transistor, and EM_STV_WD≤EM_STV_WD_LP1<EM_STV_WD_LP2<EM_STV_WD_LP3<EM_STV_WD_LP4<EM_STV_WD_LP5<EM_STV_WD_LP6. That is, in some embodiments, under the power saving mode, the widths of pulse signals change (e.g., increase or decrease) consistently and exponentially, e.g., gradually increase or gradually decrease in an exponential manner, depending on the display panel as described above.

In some embodiments, the frame rate under the power saving mode is equal to or lower than the frame rate under the normal mode such that the frame length under the power saving mode (depicted as FRAME LENGTH_LP) is equal to or greater than the frame length under the power saving mode (depicted as FRAME LENGTH). In various embodiments, FRAME LENGTH_LP may be a constant value or may vary (e.g., decrease) with time. In some embodiments, FRAME LENGTH_LP may start increasing from at least one frame under power saving mode. In some embodiments, a ratio of EM_STV_WDL over FRAME LENGTH is different from a ratio of EM_STV_WD_LPLn over FRAME LENGTH_LP. In some embodiments, a ratio of EM_STV_WD over FRAME LENGTH is different from a ratio of EM_STV_WD_LPn over FRAME LENGTH_LP. By driving display 102 using driving scheme 601, the power consumption of display 102 under power saving mode can be decreased compared to that under normal mode, and flickering of light-emitting elements under power saving mode can be reduced or eliminated. In some embodiments, the number of frames under the power saving mode may be equal to or less than 4.

Although not shown, in some embodiments, in a frame under the power saving mode, light emitting enable signal EM_STV may include a pulse signal (e.g., a low period for a P-type transistor or a high period for an N-type transistor) having a plurality of sub-pulse signals, each have a respective width (i.e., duration). The sum of the widths of all sub-pulse signals may be regarded as the width of the pulse signal. The widths of the sub-pulse signals may be constant, increase, decrease, of change arbitrarily with time. The driving of display 102 under power saving mode having such a light emitting enable signal EM_STV can be consistent with driving scheme 601, and the detail is not repeated. In some embodiments, the actual luminance resulted from the light-emitting elements in frames under the power saving mode is nominally the same as the luminance by the light-emitting elements in each frame under the normal mode.

Figure 6C:
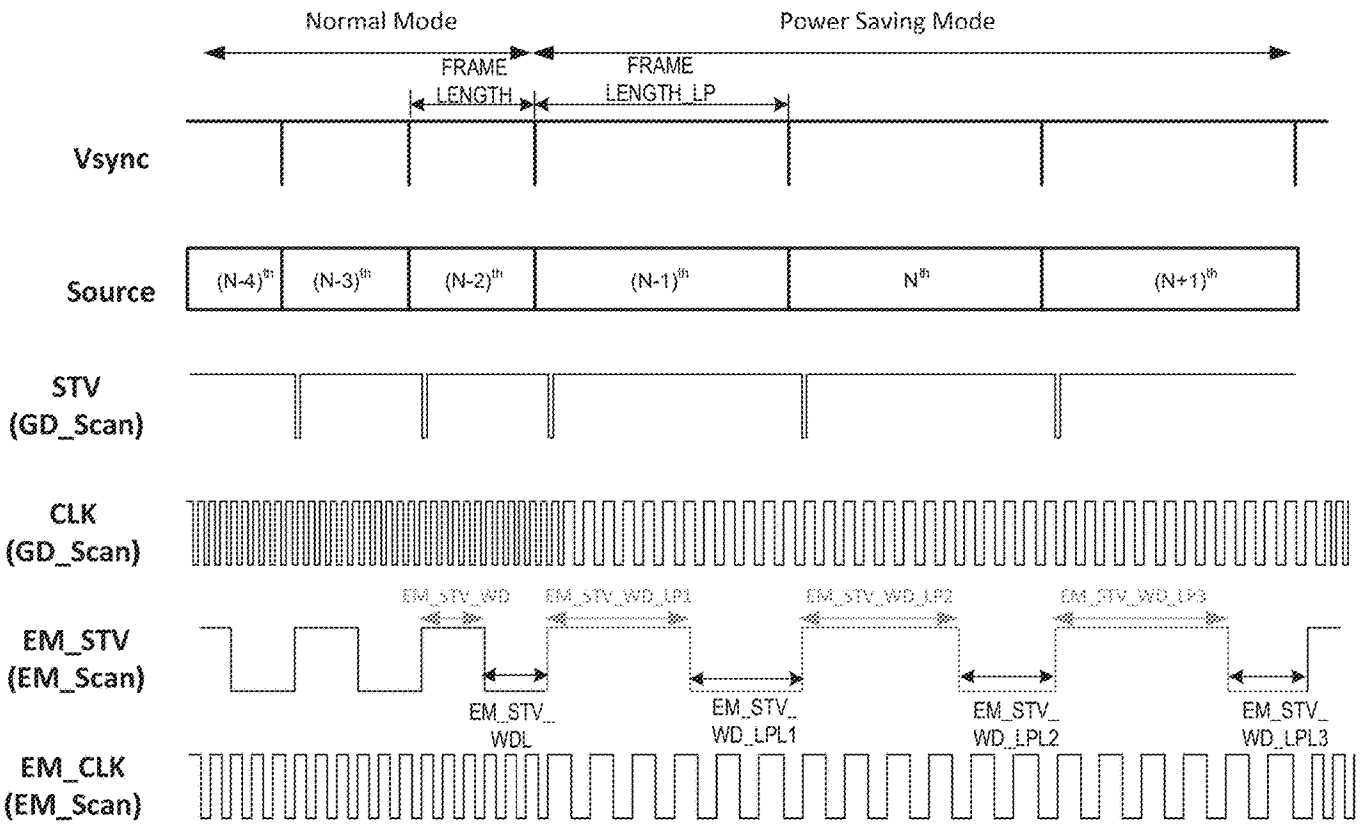

FIG. 6C is another timing diagram illustrating a driving scheme 602 of display 102 under a normal mode and a power saving mode, according to some embodiments. As shown in FIG. 6C, different from driving schemes 600 and 601, according to driving scheme 602, gate scanning enable signal STV, gate scanning clock signal CLK, and data signal each provides a respective signal/voltage under the power saving mode. Light emitting clock signal EM_CLK may scan active area 300 at a scanning rate synchronized with the respective frame rates under the normal mode and the power saving mode. In some embodiments, the frame rate under the power saving mode is lower than the frame rate under the normal mode. That is, FRAME LENGTH_LP may be greater than FRAME_LENGTH. In various embodiments, FRAME LENGTH_LP may increase, decrease, stay constant, and/or change arbitrarily with time under the power saving mode. In some embodiments, under power saving mode, for light emitting enable signal EM_STV, a width of a pulse signal in at least one of the frames may be different from that in each frame under the normal mode. In some embodiments, the actual luminance resulted from the light-emitting elements in the frame under the power saving mode is nominally the same as the luminance by the light-emitting elements in each frame under the normal mode.

As shown in FIG. 6C, in some embodiments, FRAME LENGTH_LP is greater than FRAME_LENGTH and stays constant under the power saving mode. In some other embodiments, FRAME LENGTH_LP may start increasing from at least one frame under power saving mode. The scanning rate of the data signal, gate scanning enable signal STV, and light emitting enable signal EM_STV may be the same as the respective frame rates under the power saving mode and the normal mode.

In some embodiments, as shown in FIG. 6C, the duration of the power saving mode may include a plurality of frames. As an example, 3 frames, $(N-1)^{th}$ frame, $N^{th}$ frame, and $(N+1)^{th}$ frame, are shown in FIG. 6C. Light emitting enable signal EM_STV may provide a pulse signal in each of the three frames. Under the power saving mode, in each frame, the width of the high period is depicted as EM_STV_WD_LPn, and the width of the low period is depicted as EM_STV_WD_LPLn, where n is equal to 1, 2, and 3. Under the normal mode, in each frame, the width of the high period is depicted as EM_STV_WD, and the width of the low period is depicted as EM_STV_WDL.

Figure 7B:
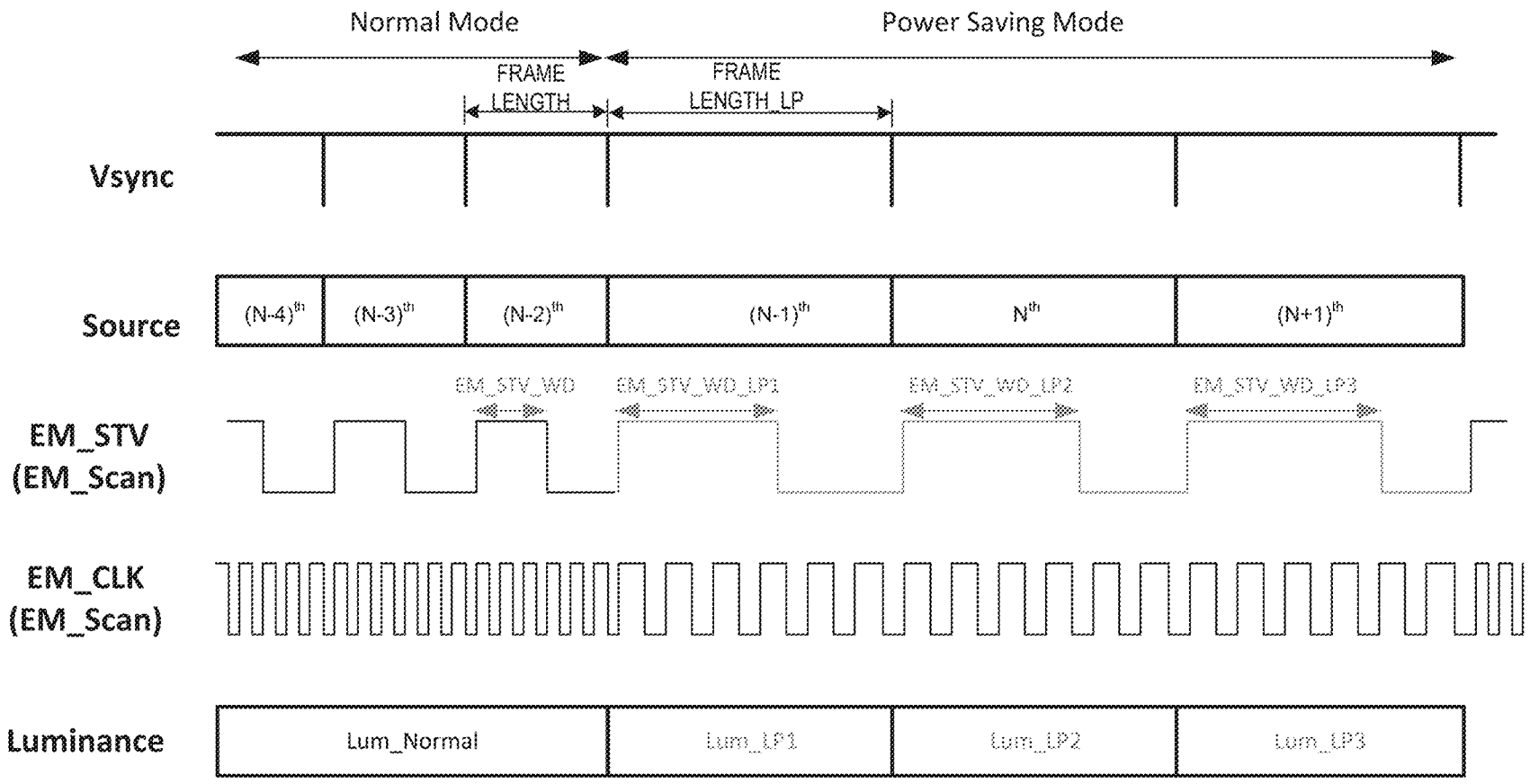

In some embodiments, driving transistor Td is a P-type transistor, and the width of the pulse signal of light emitting enable signal EM_STV in each frame is the width of the low period in the frame. In some embodiments, EM_STV_WDL≥EM_STV_WD_LPL1>EM_STV_WD_LPL2>EM_STV_WD_LPL3. In some embodiments, driving transistor Td is an N-type transistor, and the width of the pulse signal in light emitting enable signal EM_STV in each frame is the width of the high period in the frame. In some embodiments, EM_STV_WD≥EM_STV_WD_LP1>EM_STV_WD_LP2>EM_STV_WD_LP3. In some embodiments, a ratio of EM_STV_WDL over FRAME LENGTH is different from a ratio of EM_STV_WD_LPLn over FRAME LENGTH_LP. In some embodiments, a ratio of EM_STV_WD over FRAME LENGTH is different from a ratio of EM_STV_WD_LPn over FRAME LENGTH_LP. In some embodiments, the number of frames under the power saving mode may be equal to or less than 4. In some embodiments, as shown in FIG. 7B, the actual luminance of the light-emitting elements during each of the 3 frames under the power saving mode, e.g., depicted as Lum_LP1, Lum_LP2, and Lum_LP3, may be nominally the same as one another. In some embodiments, Lum_LP1, Lum_LP2, and Lum_LP3 may each be nominally the same as Lum_Normal, which represents the luminance of the light-emitting elements in each frame under the normal mode. By driving display 102 using driving scheme 602, the power consumption of display 102 under power saving mode can be decreased compared to that under normal mode, and flickering of light-emitting elements under power saving mode can be reduced or eliminated.

As described above, under power saving mode, the differences in display panels may result in the actual luminance of the light-emitting element to decrease with time and is lower than a desired luminance. In some embodiments, driving transistor Td is a P-type transistor, and the width of the pulse signal of light emitting enable signal EM_STV in each frame is the width of the low period in the frame. In some embodiments, EM_STV_WDL≤EM_STV_WD_LPL1<EM_STV_WD_LPL2<EM_STV_WD_LPL3. In some embodiments, driving transistor Td is an N-type transistor, and the width of the pulse signal in light emitting enable signal EM_STV in each frame is the width of the high period in the frame. In some embodiments, EM_STV_WD≤EM_STV_WD_LP1<EM_STV_WD_LP2<EM_STV_WD_LP3. In some embodiments, a ratio of EM_STV_WDL over FRAME LENGTH is different from a ratio of EM_STV_WD_LPLn over FRAME LENGTH_LP. In some embodiments, a ratio of EM_STV_WD over FRAME LENGTH is different from a ratio of EM_STV_WD_LPn over FRAME LENGTH_LP. In some embodiments, Lum_LP1, Lum_LP2, and Lum_LP3 may each be nominally the same as Lum_Normal, which represents the luminance of the light-emitting elements in each frame under the normal mode. That is, in some embodiments, under the power saving mode, the widths of pulse signals change (e.g., increase or decrease) consistently and exponentially, e.g., gradually increase or gradually decrease in an exponential manner, depending on the display panel as described above.

Although not shown, similar to driving scheme 601, in some embodiments, in a frame under the power saving mode, a pulse signal (e.g., a low period for a P-type transistor and a high period for an N-type transistor) may include a plurality of sub-pulse signals, each of which have a respective width. The sum of the widths of all sub-pulse signals may be regarded as the width of the pulse signal. The widths of the sub-pulse signals may be constant, increase, decrease, of change arbitrarily with time. The driving of display 102 under power saving mode having such a light emitting enable signal EM_STV can be consistent with driving scheme 602, and the detail is not repeated. In some embodiments, the actual luminance resulted from the light-emitting elements in the frame under the power saving mode is nominally the same as the luminance by the light-emitting elements in each frame under the normal mode.

Figure 8:
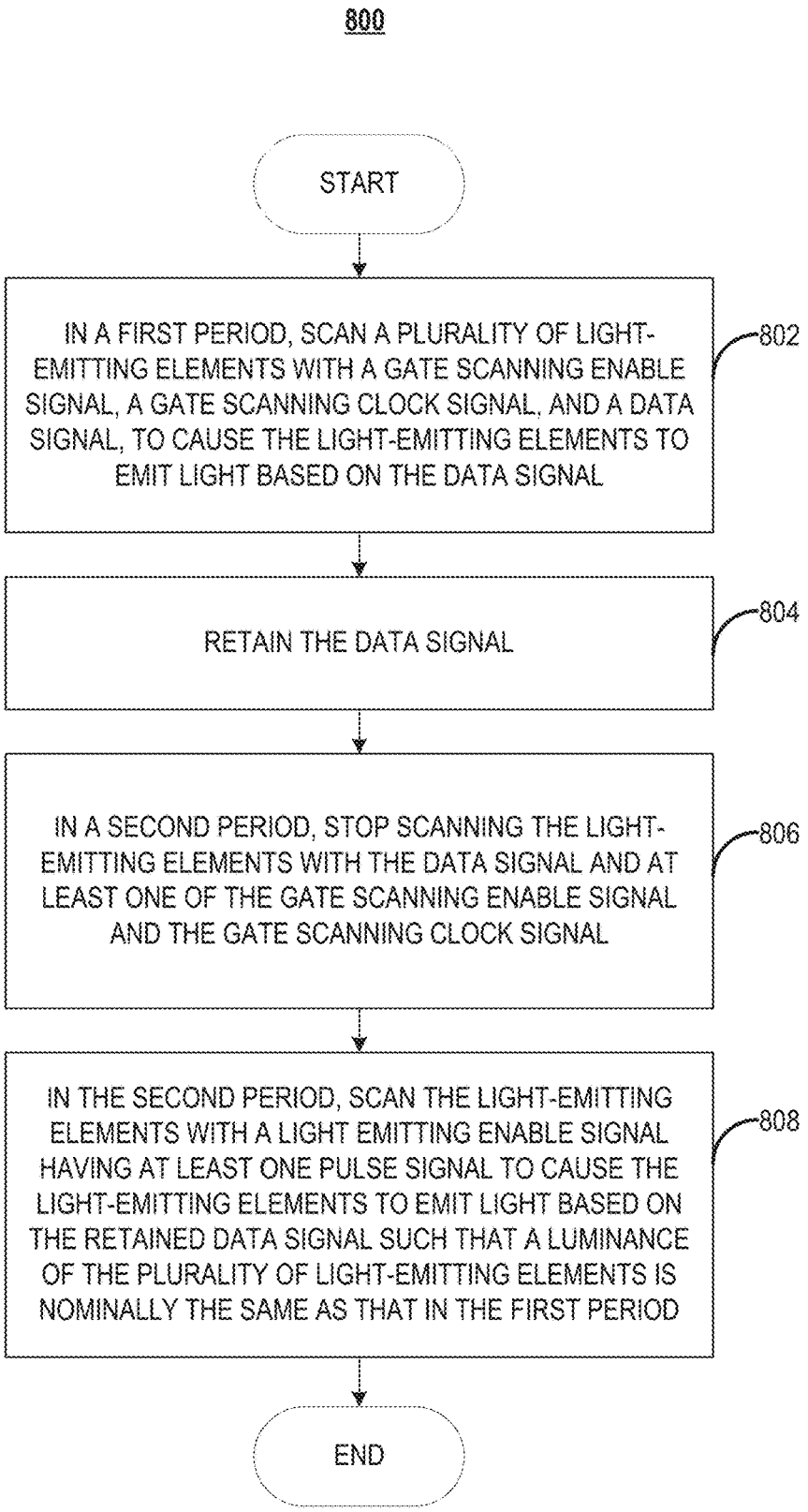
FIG. 8 is a flow chart of a method for driving the OLEDs in a display in accordance with an embodiment.

FIG. 8 is a flow chart of a method for driving a plurality of light-emitting elements on a display panel in accordance with an embodiment. It will be described with reference to the above figures. However, any suitable circuit, logic, unit, or module may be employed. The method can be performed by any suitable circuit, logic, unit, or module that can comprise hardware (e.g., circuitry, dedicated logic, programmable logic, microcode, etc.), software (e.g., instructions executing on a processing device), firmware, or a combination thereof.

Starting at 802, in a first period, a plurality of light-emitting elements are scanned with a gate scanning enable signal, a light emitting enable signal, and a data signal to emit light based on the data signal. A gate scanning clock signal and a light emitting clock signal, respectively synchronized with the gate scanning enable signal and the light emitting enable signal, may also be provided. The first period may represent a duration under a normal mode. For example, the first period may represent a frame under the normal mode. This may be performed by gate scanning driver 304, light emitting driver 302, and source writing driver 306. At 804, the data signal is retained. The data signal to each light-emitting element can be retained by the respective storage capacitor Cs operatively coupled to each light-emitting element. This may be performed by the storage capacitors Cs. At 806, in a second period, the data signal and at least one of the gate scanning enable signal and the gate scanning clock signal are stopped such that the light-emitting elements are not scanned with the data signal and the at least one of the gate scanning enable signal and the gate scanning clock signal. In some embodiments, each of gate scanning enable signal, and the gate scanning clock signal has a zero scanning rate. The second period may represent a duration under power saving mode. For example, the second period may represent a frame under the power saving mode. This may be performed by gate scanning driver 304, light emitting driver 302, and source writing driver 306. At 808, in the second period, the light-emitting elements are scanned with a light emitting enable signal having at least one pulse signal to cause the light-emitting elements to emit light based on the retained data signal such that the actual luminance of the light-emitting elements is the same as that in the first period. The width of the pulse signal may be different from (e.g., less than) that in a frame under the normal mode. This can be performed by light emitting driver 302 and storage capacitors Cs. In some embodiments, 806 and 808 can be performed simultaneously.

In some embodiments, in the second period, gate scanning driver 304, light emitting driver 302, and source writing driver 306 respectively provide a gate scanning enable signal STV, a light emitting enable signal STV, and a data signal that have the same scanning rate lower than the frame rate of the first period. Light emitting driver 302 may provide the light emitting enable signal having at least one pulse signal to cause the light-emitting elements to emit light based on the data signal such that the actual luminance of the light-emitting elements in the second period is the same as that in the first period. The width of the pulse signal may be different from (e.g., less than) that in a frame under the normal mode.

It should be noted that, in the embodiments of the present disclosure, the widths of the pulse signals, in light emitting enable signal under the power saving mode, can be determined by control logic 104, processor 114, and/or light emitting driver 302. In some embodiments, the width of the pulse signal in each frame under the power saving mode is individually adjusted such that the actual luminance caused by the light-emitting elements in each frame under the power saving mode is nominally the same as one another. In some embodiments, the actual luminance in each frame under the power saving mode is nominally the same as the luminance in a frame (e.g., each frame) under the normal mode.

Also, integrated circuit design systems (e.g., work stations) are known that create wafers with integrated circuits based on executable instructions stored on a computer-readable medium such as but not limited to CDROM, RAM, other forms of ROM, hard drives, distributed memory, etc. The instructions may be represented by any suitable language such as but not limited to hardware descriptor language (HDL), Verilog or other suitable language. As such, the logic, units, and circuits described herein may also be produced as integrated circuits by such systems using the computer-readable medium with instructions stored therein.

Embodiments of the present disclosure provide an apparatus for display. The apparatus includes an active region having a plurality of light-emitting elements, a gate scanning driver operatively coupled to the active region and configured to stop a gate scanning signal to the plurality of light-emitting elements in a period, and a light emitting driver operatively coupled to the active region and configured to cause the plurality of light-emitting elements to emit light in the period.

In some embodiments, the gate scanning signal includes a gate scanning enable signal and a gate scanning clock signal and a scanning rate of at least one of the gate scanning enable signal and the gate scanning clock signal is equal to zero in the period.

In some embodiments, the scanning rate of each of the gate scanning enable signal and the gate scanning clock signal is equal to zero in the period.

In some embodiments, the apparatus further includes a source driving driver operatively coupled to the active region and configured to provide a data signal to the plurality of light-emitting elements immediately prior to the period and stop providing the data signal in the period.

In some embodiments, the apparatus further includes a capacitor operatively coupled to the plurality of light-emitting elements and configured to, during the period, retain the data signal provided immediately prior to the period.

In some embodiments, the light emitting driver is configured provide a light emitting enable signal and a light emitting clock signal in the period and in a frame immediately prior to the period. In some embodiments, a scanning rate of the light emitting enable signal in the period is less than or equal to a scanning rate in the frame.

In some embodiments, the light emitting driver is configured to provide the light emitting enable signal having a pulse signal in at least one frame in the period. In some embodiments, a width of the pulse signal is different from a width of another pulse signal in the frame immediately prior to the period.

In some embodiments, the light emitting driver is configured to, in the period, provide the light emitting enable signal having a plurality of pulse signals in a plurality of frames, a width of a respective pulse signal in a latter frame being different from a width of a respective pulse signal in a prior frame.

In some embodiments, a ratio of the width of a pulse signal to a respective frame length in the frame immediately prior to the period is different from a ratio of the width of a pulse signal width to a respective frame length in the period.

In some embodiments, the pulse signal comprises a plurality of sub-pulse signals. In some embodiments, a width of the pulse signal is equal to a sum of widths of the plurality of sub-pulse signals.

In some embodiments, widths of the pulse signals in the plurality of frames gradually decrease.

In some embodiments, widths of the pulse signals in the plurality of frames gradually increase.

In some embodiments, a number of the plurality of frames is equal to or less than 4.

In some embodiments, in the period, the widths of pulse signals change exponentially with time in the plurality of frames such that a luminance by the plurality of light-emitting elements in each of the plurality of frames is nominally the same.

Embodiments of the present disclosure provide an apparatus for display. The apparatus includes an active region having a plurality of light-emitting elements, and a light emitting driver operatively coupled to the active region. The light emitting driver is configured to provide a light emitting signal that causes the plurality of light-emitting elements to emit light in a first period and a second period. The light emitting signal includes a light emitting enable signal that scans the plurality of light-emitting elements at a first scanning rate in the first period and a second scanning rate in the second period. The first scanning rate is higher than the second scanning rate. Of the light emitting enable signal, a width of a pulse signal in a frame in the first period is different from a width of another pulse signal in a frame in the second period.

In some embodiments, a ratio of the width of the pulse signal to a respective frame length in is different from a ratio of the width of the other pulse signal to a respective frame length.

In some embodiments, the second period includes a plurality of frames, a frame length of each of the frames in the second period being greater than each frame length in the first period. In some embodiments, in the second period, the width of a pulse signal in a latter frame is less than the width of a pulse signal in a prior frame.

In some embodiments, in the second period, widths of pulse signals in the plurality of frames change exponentially such that a luminance corresponding to each of the plurality of frames is nominally the same.

Embodiments of the present disclosure provide a method for driving a plurality of light-emitting elements on a display panel. The method includes scanning the plurality of light-emitting elements in a first period, causing the plurality of light-emitting elements to emit light based on a data signal in the first period, and retaining the data signal. The method may further include scanning the plurality of light-emitting elements in a second period, and causing the plurality of light-emitting elements to emit light based on the data signal in the second period.

In some embodiments, the method further includes applying, in the first period, a gate scanning enable signal and a gate scanning clock signal to the plurality of light-emitting elements, each of the gate scanning enable signal and the gate scanning clock signal having a non-zero scanning rate. In some embodiments, the method further includes applying, in the second period, no gate scanning enable signal and no gate scanning clock signal to the plurality of light-emitting elements.

In some embodiments, the method further includes applying, in the second period, a light emitting enable signal to the plurality of light-emitting elements. Determining the light emitting enable signal includes determining a width of a first pulse signal in a first frame in the second period to be different from a width of another pulse signal in a frame in the first period such that a luminance corresponding to the first frame in the second period and a luminance corresponding to the frame in the first period are nominally the same. Determining the light emitting enable signal also includes determining, in the second period, a width of a second pulse signal in a second frame after the first frame such that a luminance corresponding to the second frame and the luminance corresponding to the first frame are nominally the same.

For example, an integrated circuit with the afore-described logic, units, and circuits may be created using such integrated circuit fabrication systems. The computer-readable medium stores instructions executable by one or more integrated circuit design systems that causes the one or more integrated circuit design systems to design an integrated circuit. In one example, the designed integrated circuit includes a timing controller and a clock generator. The timing controller is configured to provide a first set of enable signals and a second set of enable signals. The clock generator is configured to provide a first set of clock signals associated with a first clock frequency and a second set of clock signals associated with a second clock frequency that is higher than the first clock frequency. The first set of enable signals and the first set of clock signals control a gate scanning driver to sequentially scan a plurality of rows of subpixels on a display panel in accordance with the first clock frequency. The second set of enable signals and the second set of clock signals control light emitting driver to sequentially cause the plurality of rows of subpixels to start emitting light in accordance with the second clock frequency.

The above-detailed description of the disclosure and the examples described therein have been presented for the purposes of illustration and description only and not by limitation. It is therefore contemplated that the present disclosure cover any and all modifications, variations or equivalents that fall within the spirit and scope of the basic underlying principles disclosed above and claimed herein.

What is claimed is:

1. An apparatus for display, comprising:

an active region comprising a plurality of light-emitting elements;

a gate scanning driver operatively coupled to the active region and configured to stop a gate scanning signal to the plurality of light-emitting elements for a period, the period comprising at least one frame; and a light emitting driver operatively coupled to the active region and configured to cause the plurality of light-emitting elements to emit light in the period, wherein the light emitting driver is configured provide a light emitting enable signal and a light emitting clock signal in the period and in another frame immediately prior to the period;

the light emitting enable signal has a pulse signal in the at least one frame in the period, a width of the pulse signal is different from a width of another pulse signal in the other frame immediately prior to the period; and a scanning rate of the light emitting enable signal in the period is less than or equal to a scanning rate in the other frame.

2. The apparatus of claim 1, wherein the gate scanning signal comprises a gate scanning enable signal and a gate scanning clock signal; and a scanning rate of at least one of the gate scanning enable signal and the gate scanning clock signal is equal to zero in the period.

3. The apparatus of claim 2, wherein the scanning rate of each of the gate scanning enable signal and the gate scanning clock signal is equal to zero in the period.

4. The apparatus of claim 1, further comprising a source driving driver operatively coupled to the active region and configured to provide a data signal to the plurality of light-emitting elements immediately prior to the period and stop providing the data signal in the period.

5. The apparatus of claim 4, further comprising a capacitor operatively coupled to the plurality of light-emitting elements and configured to, during the period, retain the data signal provided immediately prior to the period.

6. The apparatus of claim 1, wherein the light emitting driver is configured to, in the period, provide the light emitting enable signal having a plurality of pulse signals in the at least one frame, a width of a respective pulse signal in a latter frame being different from a width of a respective pulse signal in a prior frame.

7. The apparatus of claim 6, wherein widths of the pulse signals in the period gradually decrease.

8. The apparatus of claim 6, wherein widths of the pulse signals in the period gradually increase.

9. The apparatus of claim 6, wherein a number of the at least one frame is equal to or less than 4.

10. The apparatus of claim 6, wherein, in the period, the widths of pulse signals change exponentially with time in the at least one frame such that a luminance by the plurality of light-emitting elements in each of the at least one frame is nominally the same.

11. The apparatus of claim 1, wherein a ratio of the width of a pulse signal to a respective frame length in the other frame immediately prior to the period is different from a ratio of the width of a pulse signal to a respective frame length in the period.

12. An apparatus for display, comprising:

an active region comprising a plurality of light-emitting elements; and a light emitting driver operatively coupled to the active region and configured to provide a light emitting signal that causes the plurality of light-emitting elements to emit light in a first period and a second period, wherein the light emitting signal comprises a light emitting enable signal that scans the plurality of light-emitting elements at a first scanning rate in the first period and a second scanning rate in the second period, the first scanning rate being higher than or equal to the second scanning rate; and of the light emitting enable signal, a width of a pulse signal in a frame in the first period is different from a width of another pulse signal in a frame in the second period.

13. The apparatus of claim 12, wherein a ratio of the width of the pulse signal to a respective frame length in is different from a ratio of the width of the other pulse signal to a respective frame length.

14. The apparatus of claim 12, wherein the second period comprises a plurality of frames, a frame length of each of the frames second period being greater than each frame length in the first period; and in the second period, the width of a pulse signal in a latter frame is less than the width of a pulse signal in a prior frame.

15. The apparatus of claim 14, wherein in the second period, widths of pulse signals in the plurality of frames change exponentially such that a luminance corresponding to each of the plurality of frames is nominally e same.

16. A method for driving a plurality of light-emitting elements on a display panel, comprising:

scanning the plurality of light-emitting elements in a first period;

causing the plurality of light-emitting elements to emit light based on a data signal in the first period;

retaining the data signal;

scanning the plurality of light-emitting elements in a second period;

applying, in the second period, a light emitting enable signal to the plurality of light-emitting elements, wherein determining the light emitting enable signal comprises determining a width of a first pulse signal in a first frame in the second period to be different from a width of another pulse signal in a frame in the first period such that a luminance corresponding to the first frame in the second period and a luminance corresponding to the frame in the first period are nominally the same; and causing the plurality of light-emitting elements to emit light based on the data signal and the light emitting enable signal; in the second period.

17. The method of claim 16, further comprising:

applying, in the first period, a gate scanning enable signal and a gate scanning clock signal to the plurality of light-emitting elements; each of the gate scanning enable signal and the gate scanning clock signal having a non-zero scanning rate; and applying, in the second period, no gate scanning enable signal and no gate scanning clock signal to the plurality of light-emitting elements.

18. The method of claim 16, wherein determining the light emitting enable signal further comprises:

determining, in the second period, a width of a second pulse signal in a second frame after the first frame such that a luminance corresponding to the second frame and the luminance corresponding to the first frame are nominally the same.

* * * * *